US010845013B2

(12) United States Patent
Tolen et al.

(10) Patent No.: US 10,845,013 B2
(45) Date of Patent: Nov. 24, 2020

(54) FLEXIBLE LIGHT ASSEMBLY

(71) Applicant: Vista Manufacturing Inc., Elkhart, IN (US)

(72) Inventors: Alexander Tolen, Mishawaka, IN (US); Mitchell Bruhn, Elkhart, IN (US); Ian Michael Frank, Mishawaka, IN (US)

(73) Assignee: Vista Manufacturing Inc, Elkhart, IN (US)

( * ) Notice: Subject to any disclaimer, the term of this patent is extended or adjusted under 35 U.S.C. 154(b) by 0 days.

(21) Appl. No.: 16/592,395

(22) Filed: Oct. 3, 2019

(65) Prior Publication Data

US 2020/0109828 A1 Apr. 9, 2020

Related U.S. Application Data

(60) Provisional application No. 62/740,644, filed on Oct. 3, 2018.

(51) Int. Cl.

| | |
|---|---|
| ***F21V 7/04*** | (2006.01) |
| ***F21S 4/26*** | (2016.01) |
| ***F21V 21/088*** | (2006.01) |
| ***F21V 21/08*** | (2006.01) |
| ***H05B 47/19*** | (2020.01) |
| *F21Y 115/10* | (2016.01) |

(52) U.S. Cl.

CPC ..... *F21S 4/26* (2016.01); *F21V 21/088* (2013.01); *F21V 21/0808* (2013.01); *H05B 47/19* (2020.01); *F21Y 2115/10* (2016.08)

(58) Field of Classification Search

CPC ..... F21S 4/28; F21Y 2115/10; F21V 29/83; F21V 23/004

USPC ..... 362/555, 277–278, 29.02–29.04

See application file for complete search history.

(56) References Cited

U.S. PATENT DOCUMENTS

| | | | | |
|---|---|---|---|---|
| 4,597,033 | A | 6/1986 | Meggs et al. | |
| 4,996,632 | A | 2/1991 | Aikens | |
| 5,032,960 | A | 7/1991 | Katoh | |
| 6,361,186 | B1 | 3/2002 | Slayden | |
| 6,371,637 | B1 * | 4/2002 | Atchinson | F21V 19/005 362/249.04 |
| 6,914,194 | B2 | 7/2005 | Fan | |
| 7,140,751 | B2 | 11/2006 | Lin | |
| 8,198,109 | B2 | 6/2012 | Lerman et al. | |
| 8,322,883 | B2 | 12/2012 | Cleaver et al. | |
| 8,366,291 | B2 | 2/2013 | Hoffmann | |

(Continued)

FOREIGN PATENT DOCUMENTS

| | | |
|---|---|---|
| CN | 2677740 Y | 2/2005 |
| CN | 2722303 Y | 8/2005 |

(Continued)

*Primary Examiner* — Ali Alavi

(74) *Attorney, Agent, or Firm* — Warner Norcross + Judd LLP

(57) ABSTRACT

A flexible light assembly includes a flexible elongated enclosure and a flexible light circuit board, which includes a plurality of light sources mounted thereto. The flexible elongated body includes a channel with a bottom surface and at least one support for supporting the flexible light circuit board above the bottom surface wherein when the flexible light circuit board is inserted into the flexible elongated enclosure there is a space between bottom side of the circuit board and the bottom surface of the channel to allow air flow there between.

21 Claims, 14 Drawing Sheets

(56) References Cited

U.S. PATENT DOCUMENTS

| | | | | |
|---|---|---|---|---|
| 8,851,716 | B2 | 10/2014 | Bertram et al. | |
| 8,985,811 | B2 | 3/2015 | Huang et al. | |
| 9,200,757 | B2 | 12/2015 | Ariyoshi et al. | |
| 9,285,084 | B2 | 3/2016 | Amrine, Jr. et al. | |
| 9,546,765 | B2 | 1/2017 | Dai et al. | |
| 9,695,991 | B2 * | 7/2017 | Camarota | F21K 9/69 |
| 9,719,637 | B2 | 8/2017 | Boonekamp et al. | |
| 10,458,604 | B2 | 10/2019 | Camarota | |
| 2004/0080835 | A1 | 4/2004 | Chinniah et al. | |
| 2005/0231947 | A1 | 10/2005 | Sloan et al. | |
| 2007/0076427 | A1 * | 4/2007 | Reo | F21V 17/164 362/555 |
| 2008/0088770 | A1 | 4/2008 | Hwang et al. | |
| 2010/0157608 | A1 | 6/2010 | Chen et al. | |
| 2011/0286207 | A1 | 11/2011 | Chan et al. | |
| 2011/0305024 | A1 | 12/2011 | Chang | |
| 2012/0106144 | A1 | 5/2012 | Chang | |
| 2012/0170258 | A1 | 7/2012 | VanDuinen et al. | |
| 2012/0250301 | A1 | 10/2012 | Tung et al. | |
| 2013/0016508 | A1 | 1/2013 | Progl et al. | |
| 2013/0021811 | A1 * | 1/2013 | Goldwater | B29C 45/14655 362/473 |
| 2013/0286643 | A1 | 10/2013 | Chen et al. | |
| 2014/0313722 | A1 * | 10/2014 | Eloff | A47B 95/043 362/249.04 |
| 2015/0009673 | A1 | 1/2015 | Wu et al. | |
| 2015/0276166 | A1 | 10/2015 | Snijkers et al. | |
| 2016/0138768 | A1 * | 5/2016 | Greene | H05B 45/40 362/249.04 |
| 2017/0268732 | A1 | 9/2017 | Camarota | |

FOREIGN PATENT DOCUMENTS

| | | | |
|---|---|---|---|
| CN | 2784721 | Y | 5/2006 |
| CN | 101010540 | A | 8/2007 |
| CN | 201206752 | Y | 3/2009 |
| CN | 101482237 | A | 7/2009 |
| CN | 1954173 | B | 4/2010 |
| CN | 201696956 | U | 1/2011 |
| CN | 201866689 | U | 6/2011 |
| CN | 201954351 | U | 8/2011 |
| CN | 201992452 | U | 9/2011 |
| CN | 202747275 | U | 2/2013 |
| CN | 202769405 | U | 3/2013 |
| CN | 102072428 | B | 5/2013 |
| CN | 102635831 | B | 3/2014 |
| CN | 103375695 | B | 12/2017 |
| EP | 1000295 | B1 | 7/2014 |
| EP | 3008377 | B1 | 11/2017 |
| JP | 2010067367 | A | 3/2010 |
| JP | 4870077 | B2 | 2/2012 |
| KR | 20140087597 | A | 7/2014 |
| WO | 2005017408 | A1 | 2/2005 |
| WO | 2011110217 | A1 | 9/2011 |

* cited by examiner

FLEXIBLE LIGHT ASSEMBLY

CROSS-REFERENCE TO RELATED APPLICATION

This application claims the benefit of U.S. Provisional Patent Application No. 62/740,644, filed on Oct. 3, 2018, which is incorporated herein by reference in its entirety and is commonly owned by Vista Manufacturing Inc. of Elkhart, Ind.

BACKGROUND AND TECHNICAL FIELD

The present disclosure relates to light assemblies, and especially flexible LED light assemblies.

Flexible light assemblies may can be used in a variety of different applications and may be mounted using a number of different mounting arrangements. For example, the light assemblies described here may be used in outdoor applications, such as such landscape, marine, tractor trailer, recreational vehicle (RV), or aviation applications, or in indoor applications, such as on furniture or appliances. Many times the location of the light assemblies make it difficult to reach for manual control of the light output or alternately require extensive wiring to provide remote control.

SUMMARY OF THE INVENTION

Accordingly, a light assembly is disclosed that provides an enclosure system that is suitable for most, if not all, applications and in some embodiments provides wireless remote control of the light sources contained in the light assembly to facilitate their use and adjustment. In other embodiments, the enclosure is a flexible enclosure with a channel with two or more raised portions for supporting a flexible light circuit in the channel but spaced above the bottom of the channel to facilitate assembly and improve air circulation around the flexible light circuit.

In one embodiment, a flexible light assembly includes a flexible elongated enclosure and a flexible light circuit board, which includes a plurality of light sources mounted thereto. The flexible elongated body includes a channel with a bottom surface and at least one support for supporting the flexible light circuit board above the bottom surface wherein when the flexible light circuit board is inserted into the flexible elongated enclosure there is a space between bottom side of the circuit board and the bottom surface of the channel to allow air flow there between.

In one embodiment, the flexible elongated body includes an upper wall, which forms a light output surface, opposed side walls, and a base wall, wherein the bottom surface of the channel is formed by the base wall.

In one embodiment, the support has a cross-section selected from the group consisting curved shapes and multi-side side shapes.

In one embodiment, the space between the light circuit board and the bottom surface is sufficiently small to allow the bottom surface of the flexible light circuit to be visible through the base wall of the enclosure, when the enclosure is made from a transparent or translucent material.

In one embodiment, the base wall of the enclosure is planar or at least has a planar portion to allow the flexible light assembly to be mounted to a surface using an adhesive, such as two sided adhesive tape, applied the base wall.

In one embodiment, the upper wall is curvilinear. In another embodiment, the upper wall includes a plurality of planar wall segments.

Further, in some embodiments, the upper wall may have a variable wall thickness to vary the output of the light through the light emitting surface of the enclosure. For example, the variable wall thickness may increase from the apex of the upper wall to the side walls such the apex of the upper wall has the thinnest wall cross-section and the lowest opposed sides of the upper wall that forms the light output surface have the greatest thickness.

In another embodiment, the flexible elongated enclosure has a generally uniform wall thickness except for the region where the support is located.

In another embodiment, the flexible elongated enclosure has a generally uniform wall thickness, including in the region where the support is located. For example, the support may be formed from an offset in the base wall of the housing.

In one aspect, in any of the above, the flexible elongated enclosure is formed from a flexible polymer material, such as a flexible polyvinylchloride (PVC) or silicone.

In any of the above, the flexible elongated enclosure includes recesses or channels formed in or by its opposed side walls to receive the opposed flanges of a mounting channel-shaped member. For example, the mounting channel-shaped member may be formed from a C-shaped member with a base wall and two opposed flanges that extend upwardly from the base wall to thereby form channel there between for receiving the flexible elongated enclosure. The opposed flanges of the mounting channel-shaped member are spaced apart and extending into the recesses of the flexible elongated enclosure below the light output surface so as not to reduce the light output of the flexible light assembly.

In any of the above, the upper wall may be configured to form a primary light output surface and secondary light output surfaces on either side of the primary light output surface depending on several factors, including the internal height of the flexible enclosure, the height of the support (or supports), the height of and space between the side walls that straddle the light sources, and/or the cross-section of the upper wall. As noted, the upper wall may be curved or may have planar sections, or may have a variable wall thickness.

In one embodiment, the side walls are offset to form the recesses. In another embodiment, the recesses are formed by notches that extend into the side walls.

In one embodiment, the channel formed by the base wall of the enclosure has a trapezoidal cross-section, with the bottom width of the channel being greater that the width of the top of the channel. In this manner, the angled sides of the channel can retain the flexible light circuit board in the channel.

In one embodiment, a flexible light assembly includes a flexible light circuit board, which includes a plurality of light sources mounted thereto, a control circuit board with a controller electrically coupled to the light sources for selectively powering the light sources, and a pair of electrical leads electrically coupled to the controller for connecting to a power supply to deliver power to the controller. The light assembly further includes a wireless receiver for receiving wireless signals from a remote wireless transmitter, which is in communication with the controller. And, the controller is responsive to signals from the wireless receiver and operable to control the light sources based on the signals from the wireless receiver. Further, the light assembly includes a first flexible enclosure, such as an adhesive layer or layers, enclosing the control circuit board, the flexible light circuit board, the wireless receiver, and a portion of the electrical leads to waterproof the light assembly to form a first flexible enclosure. A second flexible enclosure houses the control circuit board, the wireless receiver, a portion of the electrical leads, and at least a portion of flexible light circuit board over the first flexible enclosure.

In one aspect, the second flexible enclosure is formed from a silicone or polyurethane material. For example, the second flexible enclosure may comprise a heat shrinkable silicone or polyurethane tube. Further, the heat shrinkable silicone or polyurethane tube may comprise an opaque heat shrinkable silicone or polyurethane tube wherein the circuit board is not clearly visible through the second flexible enclosure but allows light transmission there through when the light sources are powered.

In another aspect, the wireless receiver comprises a WiFi receiver or a Bluetooth receiver.

According to another aspect, a channel may be provided that slidingly receives the light assembly for mounting the light assembly.

According to another aspect, the light assembly includes a second adhesive layer for mounting the light assembly.

In yet a further aspect, the second enclosure may enclose the electrical leads and extend beyond the control circuit board to form a strain relief for the electrical leads. For example, the second enclosure may extend beyond the control circuit board a distance in a range of about 0.25 to 1.5 inches.

According to yet other aspects, the first flexible enclosure encloses only one side of the flexible light circuit board and the plurality of light sources.

In a further embodiment, the first flexible enclosure forms a light emitting side with an arcuate outer surface to form a curved lens. For example, the arcuate outer surface may form an arcuate pattern in a range of about 90 to 180 degrees, and optionally at least a 120 degree light pattern about the longitudinal axis when the light sources are powered.

In yet a further aspect, when fully enclosing the flexible light circuit board and light sources, the first flexible enclosure may form a planar bearing side below the circuit board. Further, the first flexible enclosure may form two lateral sides extending between the light emitting side and the planar bearing side.

In any of the above, the light sources may comprise LED lights.

According to another embodiment, a method of forming a flexible light assembly includes providing a flexible light circuit board with a plurality of spaced light sources, a control circuit board with a controller in communication with the light sources, a wireless receiver in communication with the controller, and a pair of leads for connecting the circuit board to a power supply. A layer of adhesive is then applied around the control circuit board and a portion of the leads to form a waterproof barrier about the control circuit board and the components mounted thereon. The method further includes enclosing the layer of adhesive (and the circuit board enclosed therein), the portion of the electrical leads, and a portion of the flexible light circuit board in a translucent or transparent flexible material.

In one aspect, the layer of adhesive, the circuit board, and the portion of the leads is enclosed by heat shrinking a plastic tube about the layer of adhesive (that encloses the control circuit board), a portion of the electrical leads, and the portion of the flexible light circuit board.

DETAILED DESCRIPTION

Figure 1:
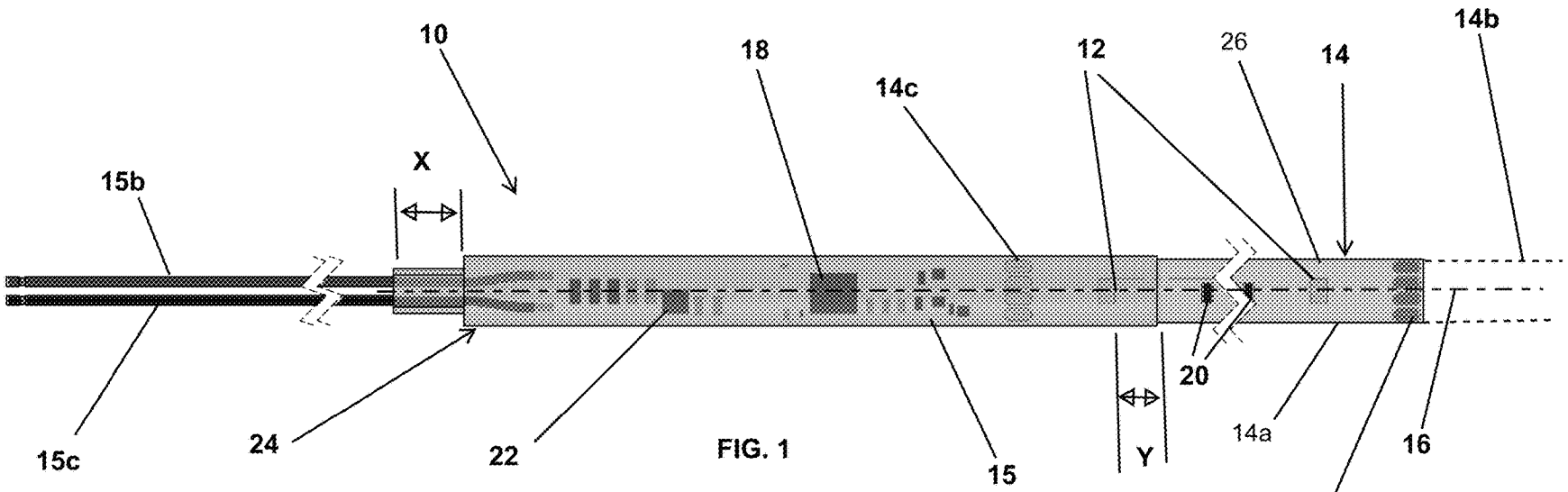
FIG. 1 is a plan view of a light assembly illustrating one flexible light circuit board.

Referring to FIG. 1, the numeral 10 generally designates a light assembly. As will be more fully described below, light assembly 10 is configured so that it can be controlled remotely to ease use and control over the functions of the light assembly, and further is optionally configured so that it is suitable for exterior use and is, therefore, water resistant or water proof.

As best seen in FIG. 1, light assembly 10 includes a plurality of longitudinally spaced light sources 12, such as LEDs, which are, for example, connected in series, and mounted on a printed light circuit board 14, optionally a flexible circuit board, along the longitudinal axis 16 of circuit board 14. As would be understood the length of the light circuit board 14, and hence light assembly 10, may be varied and may be assembled from a plurality of discrete flexible circuit boards connected end to end depending on the desired length of the light assembly. Alternately, the light circuit board 14 may be made from a flexible tape light circuit board whose length is adjusted by cutting the tape at preset cut locations along its length, as would be understood by those skilled in the art. Therefore, light circuit board 14 may be one continuous printed circuit board or may be assembled from connected discrete printed circuit boards.

In the illustrated embodiment, light assembly 10 comprises a flexible tape light circuit board that includes divisible or separable (by cutting) sections 14*a*, 14*b* (only two shown—and one shown in phantom), each with electrical connectors 14*c* at its opposed ends. Connectors 14*c* are located at cut locations, which allow the circuit board 14 to be cut to create the desired length of the light assembly. Connectors 14*c* provide electrical connections that allow the light circuit board to be coupled to a control circuit board 15, which is coupled to a pair of electrical leads 15*b*, 15*c* that are mounted to the control circuit board on one end thereof to electrically couple control circuit board 15 (and components thereon and coupled thereto) to a power supply (not shown), which is connected across the other ends of lead 15*b* and 15*c*.

Control circuit board 15 includes a controller 18, which is electrically coupled to light sources 12 mounted to circuit boards 14*a*, 14*b* to control the operation of light sources 12.

Further, as noted above, printed circuit board 14 is optionally flexible (as well as its enclosure described below) so that light assembly 10 can be mounted in a non-linear configuration or a linear configuration with one or more non-linear sections. For example, each discrete circuit board section 14*a*, 14*b*. may be formed from a flexible polymer-based printed circuit board which from a tape like structure, as noted above. Further, as will be more fully described below, light assembly 10 may be assembled so that it is waterproof, and hence suitable for outdoor applications. While only two circuit board sections are shown it should be understood that the length of the flexible polymer based circuit board (or the number of circuit board sections) may vary based on the desired length of the light assembly.

As noted above light sources 12 may comprise LEDs, and further may comprise tunable LEDs, such as RGB LEDs, RGBW LEDs, or just tunable white LEDs, which can be controlled by controller 18 to turn the lights on or off, as needed, as well as adjust the color and/or intensity (lumens) of the light emitted from the light sources. For example, a suitable controller is available from Texas Instruments, Cypress Semiconductor, or Silicon Labs. In addition to light sources 12, light circuit board 14 may also include resistors 20, which are used to limit the amount of current to the LEDs, for example, when the voltage source (e.g. from the controller) does not equal to the voltage drop of the LEDs.

To allow remote control of light sources 12, light assembly 10 includes a wireless receiver 22 in communication with controller 18. For example, wireless receiver 22 may comprise a WiFi or Bluetooth receiver, which allows control over light sources 12 via a remote control device, such as a mobile device, including a mobile phone, iPad, or other mobile electronic devices. In the illustrated embodiment, wireless receiver 22 is mounted to control circuit board 15 along with controller 18. Though it should be understood that a control module unit with a receiver integrated into the module may also be used.

As noted above, light assembly 10 is optionally waterproof or water resistant. To seal and protect the various electronic devices mounted in the light assembly, light circuit board 14 and control circuit board 15 are each at least partially, if not fully, encapsulated in a polymer layer 26, such as a polyurethane, including an adhesive glue drop polyurethane. The layer 26 may extend continuously between the circuit boards or may be separately applied. The polymer may be clear or translucent depending on its application. In the illustrated embodiment, layer 26 extends continuously along the flexible polymer based circuit board 14 and, further along, control circuit board 15.

Further, illustrated embodiment, the outer surface 26*a* that is opposed to the mounting surface layer 26*b* is a curved outer surface to form a curved lens, to refract the light emitted by light sources 12. Alternately, the outer surface may be substantially flat (have an infinite radius of curvature) or have a smaller radius or curvature described more fully below.

In addition, light assembly 10 may include a second enclosure 24 over the control board 15 and over at least over a portion of the light circuit board 14. For example, enclosure 24 may be formed from a silicone or polyurethane material, and further from a heat shrink silicone or polyurethane material, such as a heat shrink silicone or polyurethane tube.

In the illustrated embodiment, enclosure 24 houses control circuit board 15 and a portion of section 14*a* of circuit board 14, as well as a portion of electrical leads 15*b* and 15*c*. For example, enclosure 24 may extend along leads 15*b* and 15*c* a distance X from the edge of circuit board 14*a* to provide a strain gauge for the leads. For example, distance X may be in a range of 0.25 inches to 0.6 inches or about 0.4 inches (11.1 mm). Further, enclosure 24 extends over and houses electrical connectors 14*c* (between circuit board 15 and circuit board section 14*a*) and at least the first light source 12 mounted on circuit board section 14*a* and may extend beyond the first light source 12 on board section 14*a* a distance Y from the edge of board section 14*a*. For example, distance Y may be in a range of 0.1 inches to 0.4 inches or about 0.3 inches (6.7 mm).

As noted above, light assembly 10 may also have a waterproofing layer formed by layer 26 over the whole circuit board 14. Further, layer 26 (as noted such as a clear polyurethane adhesive or "clear adhesive layer") may encapsulate circuit board 14, circuit board 15, and also a portion of the electrical leads 15*b*, 15*c* at their interface with circuit board 15. As noted above, enclosure 24 may also extend along the respective leads 15*b*, 15*c* beyond the edge of circuit board 15, for example, over a distance X from edge of the circuit board 15. For example, X may be in a range of 0.25 inches to 1.5 inches or about 0.5 inches.

In another embodiment, described more fully below, one or both enclosures 24 and 26 may comprise an extrusion into which circuit board 14 and circuit board 15 are inserted and sealed therein by end caps, and optionally by silicone fill. When formed by an extrusion, enclosure 24 may be formed from a translucent, flexible material, such as polyurethane or silicone, and have a curved upper surface (surface through which the light is directed from light sources 12), which extends along the full length of circuit board 14 to form a lens to shape or diffuse the light emitted from light sources 12. For example, when view from the end of the light assembly, the light emitting side may form a light pattern angle in a range of 90 to 180 degrees, a range of 100 to 150 degrees, or at least a 120 degree light pattern about the longitudinal axis 16 (of the light assembly) when the light sources 12 are powered. For further details of alternate embodiments of the light assembly enclosures reference is made to the embodiments illustrated in FIGS. 3-15.

Figure 2:
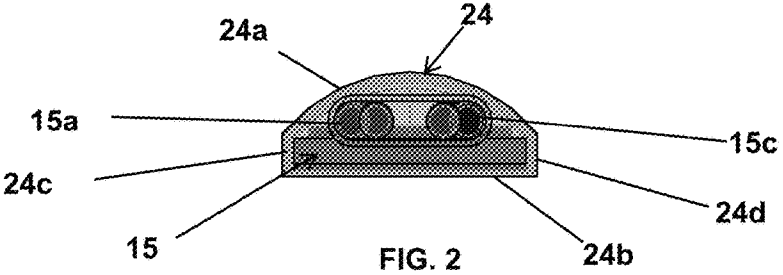
FIG. 2 is a left end view of the light assembly of FIG. 1.

As best seen in FIG. 2, enclosure 24 forms an arcuate upper side 24*a* and a planar bottom side 24*b*. Further, enclosure 24 forms two lateral sides 24*c*, 24*d* extending between the upper side 24*a* and the planar bottom side 24*b*. Enclosure 26 may similarly form an arcuate upper side and a planar bottom side, with two lateral sides extending between the upper side and the planar bottom side. In this manner, the two enclosures may have the same or similar profile. Alternately, as described in reference to the embodiment illustrated in FIGS. 3-6, enclosure 26 may have a flat upper surface.

Further, enclosure 26 may be formed from different materials, with one material forming a light output section and surface (and hence either transparent or translucent) and the other material being opaque to block light so that the direction of the light from light assembly may be customized depending on the application. For example, the light emitting surface may be formed in a limited region of the light assembly enclosure by forming the enclosure from a combination of opaque material (or light blocking material) and translucent or transparent material. For example, the light emitting surface may be formed on the side of the light assembly. For further details reference is made to FIGS. 16-18.

Figure 1A:
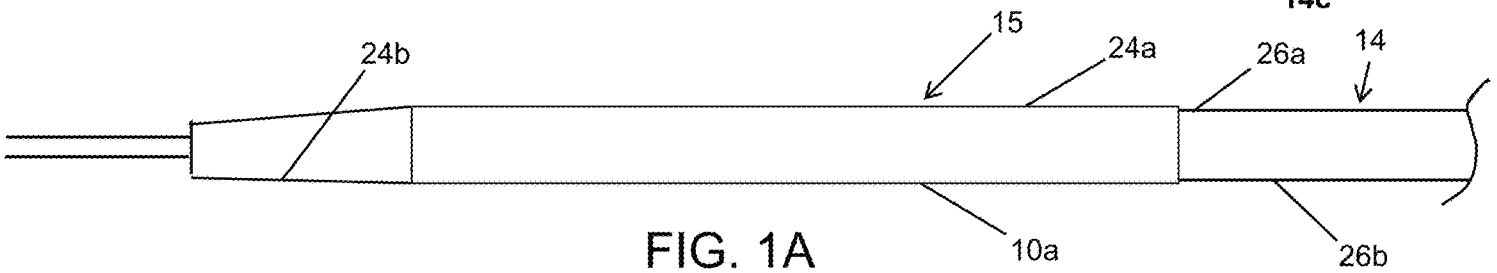
FIG. 1A is a side elevation of the light assembly of FIG. 1.

For example, the planar bottom surfaces 24*b*, 26*b* of enclosures 24 an 26 may form a bearing surface for mounting the light assembly, and further may include a second adhesive layer with a release tape to allow a user to remove the release tape and mount the light assembly simply using adhesive. In the illustrated embodiment, and referring to FIG. 1A, the mounting surface 10*a* of light assembly 10, which is formed by mounting surfaces 26*b* and 24*b* (which are substantially contiguous and colinear), is therefore substantially flat.

In the alternative, the light assembly may be inserted into a channel-shaped member, such as by sliding into an open end of the channel-shaped member, with the channel-shaped member mounting the light assembly.

When forming the enclosure or enclosures, the arcuate upper side may be formed from a uniform wall thickness of material or may have a varying thickness depending on the type of enclosure. When formed from heat shrink silicone tubing, the wall thickness may be generally uniform. When formed from an extrusion the wall thickness may also be uniform but also may be formed with a varying thickness to adjust the transmission and diffusion of the light through the wall of the enclosure.

Further, the material forming enclosure 26 may have embedded or formed therein refractive bodies or structures to modify the light being emitted from light assembly 10. Alternately (or in addition), enclosure 26 may have light blocking regions or lines (e.g. formed from light blocking material incorporated into or applied to enclosure 26—e.g. a dark pigment) to again modify the output the light from light assembly.

Figure 3:
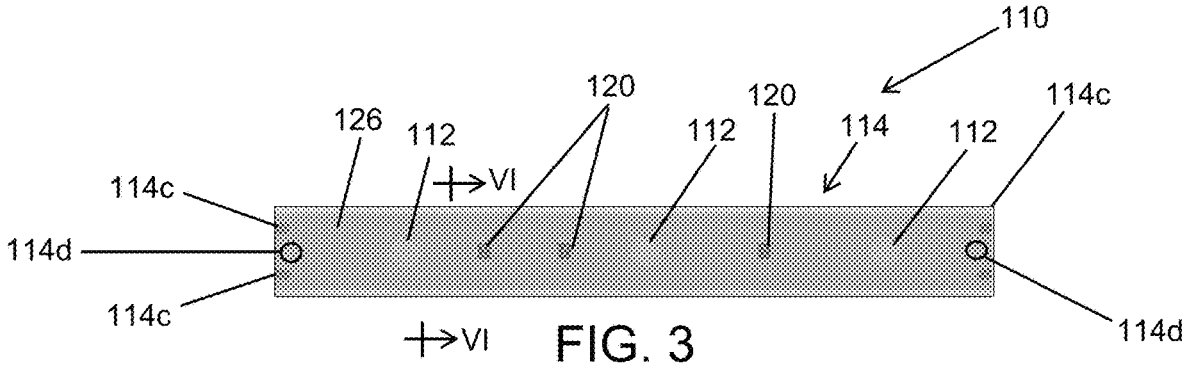
FIG. 3 is a plan view of another embodiment of a light assembly.
Figure 4:
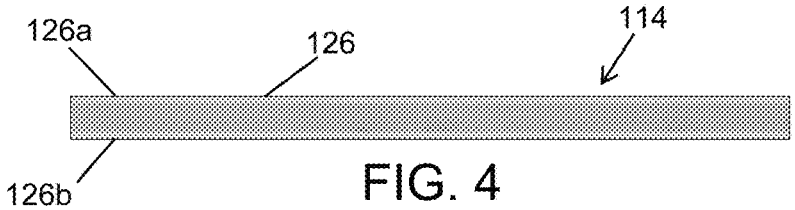
FIG. 4 is a side elevation view of the light assembly of FIG. 3.

Referring to FIG. 3, the numeral 110 designates another embodiment of a light assembly. Similar to light assembly 10, light assembly 110 includes a plurality of longitudinally spaced light sources 112, such as LEDs, which are, for example, connected in series, and mounted on a printed light circuit board 114, optionally a flexible circuit board, such as a flexible tape light circuit board whose length is adjusted by cutting the tape at preset cut locations along its length, as would be understood by those skilled in the art.

In the illustrated embodiment, light assembly 110 includes an extruded enclosure 126 formed form a flexible material, such as silicone, in which circuit board 114 is inserted. The material forming enclosure 126 may be clear (or 90-100 percent transparent) or may be translucent, in other words partially opaque with a transparency in a range of 30-90 percent or opaque with a transparency in a range of 0-30 percent. While ranges of transparency are given, it should be understood that these ranges are just guidelines and examples. Stated in another way, "clear" is used to describe a transparency that allows a person to see the discrete components (e.g. light sources 112 and resistors 120 mounted on light circuit board 114), while translucent refers to when a person can see discrete regions of light when the light sources are powered, but generally cannot see the structures on the circuit board. Opaque refers when a person cannot see the any structures on the circuit board regardless of when the lights are powered or not, and instead can only see the light assembly emitting a substantially uniform light—where all or substantially all the light is internally reflected.

Figure 5:
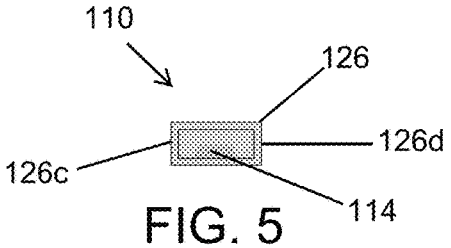
FIG. 5 is an end view of the light assembly of FIG. 4.
Figure 6:
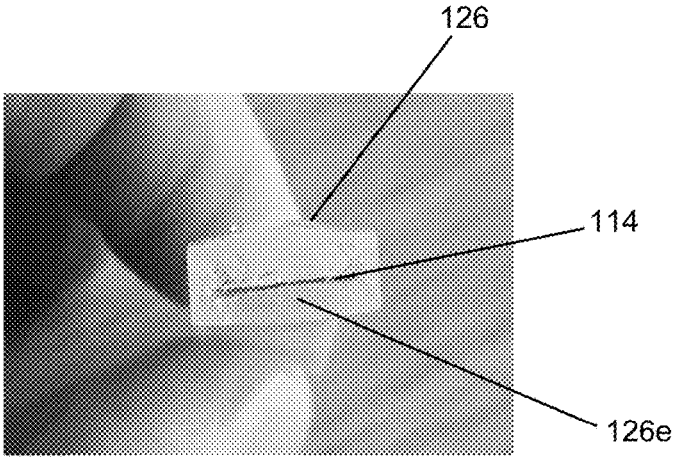
FIG. 6 is a cross-section view taken along line VI-VI of FIG. 3.

Referring to FIG. 5, enclosure 126 may have a rectangular cross-section with a flat upper wall or side 126*a*, which forms the light emitting side (when the enclosure is formed from a transparent or translucent material), a flat base wall or side 126*b*, which may form a mounting surface, and two opposed flat walls or sides 126*c*, 126*d*, which may also provide light emitting surfaces depending on the depth and/or width of the enclosure, which walls together define an open channel 126*e*. Because of the directional nature of LEDs, for slim profiles, the opposed walls or sides will not form light emitting surfaces. For narrower, taller profiles, some of the light from light sources 112 may be emitted from the opposed sides (again when the enclosure is formed from a transparent or translucent material).

Light circuit board 114, as noted above, may be formed from a flexible tape circuit board with cut locations at discrete points along the length of the tape and with electrical connectors 114*c* provided at each of its cut locations. In this manner, the circuit board 114 may be cut to create the desired length of the light assembly and then coupled to a power source, including through a control circuit board, via connectors 114*c*, such as described above. Optionally, the control circuit board may be inserted into enclosure 126 along with light circuit board 114.

After circuit board 114 is inserted into the channel 126*e* formed in enclosure 126, a silicone fill is inserted (or "shot") into channel 126*e* (FIG. 6) to further protect circuit board 114 from liquid or debris entering into light assembly 110 and also to provide cushioning to circuit board 114 when light assembly 110 is bent during installation or handling.

Alternately, enclosure 126 may be a solid flexible material, such as silicone, with the circuit board 114 co-extruded with the material forming the enclosure.

As noted above, to adjust the length of light assembly 110, circuit board 114 may have cut lines, which are provided by the circuit board manufacturer to designate where a cut can be made without damaging the circuit board's functionality. In order to better see these cut lines when circuit board 114 is fully encapsulated in enclosure 126, circuit board 114 may be provided with through holes 114*d* (FIG. 3) formed therein at the cut locations. Through holes allow light to escape through the back of circuit board 114 when light sources 112 are powered and provide powered indications of where the cut lines are located. For clear enclosures, the cut lines are generally visible through the enclosure and, therefore, the through holes may not be needed. But where the enclosures are translucent, the cut lines may not be readily visible and, hence, the through holes may provide a helpful indication of where the cut locations are located. Alternately or in addition, as described below, the material, or at least a portion of the material, forming the bottom or back side of the enclosure may be transparent to see the cut lines but with the balance of the remaining material forming the enclosure being translucent or opaque.

Figure 7:
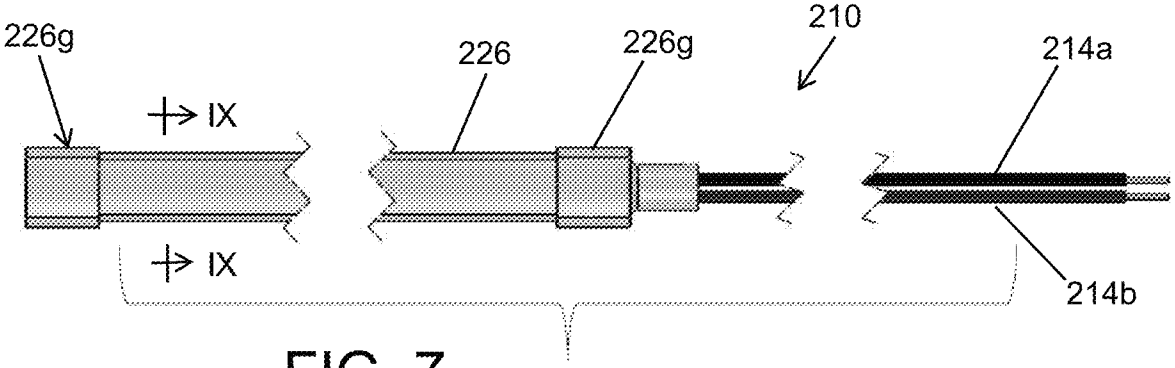
FIG. 7 is a plan view of a third embodiment of a light assembly.
Figure 8:
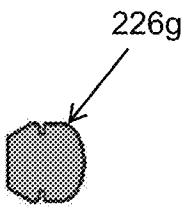
FIG. 8 is an end view of the light assembly of FIG. 7.

Referring to FIG. 7, the numeral 210 designates another embodiment of a light assembly. Similar to light assemblies 10 and 110, light assembly 210 includes a plurality of longitudinally spaced light sources, such as LEDs, which are, for example, connected in series, and mounted on a printed light circuit board 214, with resistors and electrical leads 214*a*, 214*b* for coupling the light sources to a power source. Similar to the previous embodiments, light circuit board 214 may comprise a flexible circuit board, such as a flexible tape light circuit board whose length can be adjusted by cutting the tape at preset cut locations along its length, as would be understood by those skilled in the art. For further details of the light circuit board and an optional control circuit board (which may be enclosed in enclosure 226 as well), reference is made to the above embodiments.

In the illustrated embodiment, light assembly 210 includes an extruded enclosure 226 formed from a flexible material, such as silicone, with which circuit board 214 is co-extruded. The material forming enclosure 226 may be clear (e.g. 90-100 percent transparent) or may be translucent, in other words partially opaque with a transparency in a range of 30-90 percent or opaque with a transparency in a range of 0-30 percent. While ranges of transparency are given, it should be understood that these ranges are just guidelines and examples, as noted above.

Figure 9:
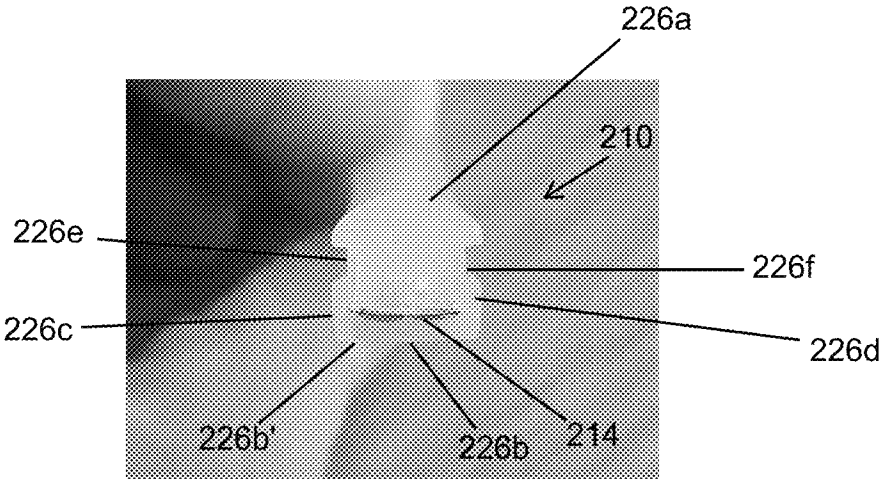
FIG. 9 is a cross-section view taken along line IX-IX of FIG. 7.

Referring to FIG. 9, enclosure 226 has a solid cross-section with a curved upper surface 226*a*, which in the illustrated embodiment forms a light emitting surface, and generally rectangular base 226*b* with a planar bottom surface 226*b*', which may form a bearing surface or mounting surface.

In the illustrated embodiment, the opposed sides 226*c* and 226*d* of base 226*b* include inwardly projecting, longitudinal grooves 226*e* and 226*f*, which are located above bottom surface 226*b*' and provide guides to slide and retain light assembly 210 in a mounting channel-shaped member (not shown) for mounting light assembly 210. For example, the mounting channel-shaped member may have inwardly projecting lips formed on its spaced flanges to extend into the respective grooves when the light assembly is inserted into the channel. Thus, grooves 226*e* and 226*f* form mechanical engagement structures for the mounting channel-shaped member to retain the light assembly in the channel. When inserted in the channel, bottom surface 226*b*' may contact and, hence, bear on the web of the mounting channel-shaped member to form a snug fit with the mounting channel-shaped member.

As noted above, light emitting surface 226*a* is arcuate and, further, together with the material of the enclosure above circuit board 214 form a lens to shape or diffuse the light emitted from the light sources. For example, the light emitting side 226*a* may form a light pattern angle in a range of 90 to 180 degrees, a range of 100 to 150 degrees, or at least a 120 degree light pattern about the longitudinal axis of the light assembly when the light sources are powered.

In the illustrated embodiment, light assembly 210 also includes end caps 226*g* mounted, for example, by an adhesive at both ends (lead and non-lead ends) of enclosure 226. End caps 226*g* each have a cylindrical body with opposed ends, with one end closed by an end wall and the other end forming a socket that is sized and shaped to receive and follow the outer surface of enclosure 226. Both the non-lead end and lead end plugs may be made out of the same material, and further the same material as enclosure 226. In this manner, when end cap 226*g* is mounted to enclosure 226, end cap 226*g* will close and seal the ends of the enclosure 226. On the lead end, the end cap 226*g* includes through holes for the leads to extend from the enclosure, which are then sealed in end cap 226*g*, and further may include by a strain relief/portion for sealing that helps the leads seal and adds strength. For example, the strain relief portion may be formed by the end cap itself or may be formed by a shrink wrap tube applied over the end cap and over a portion of the leads extending from the end cap.

Similar to the previous embodiment, light circuit board 214 may have through holes formed therein at the cut locations to provide powered indications of where the cut lines are located. Alternately or in addition, as described below, the material, or at least a portion of the material, forming the bottom or back side of the enclosure may be transparent with the balance of the material forming the enclosure being translucent or opaque.

Figure 10:
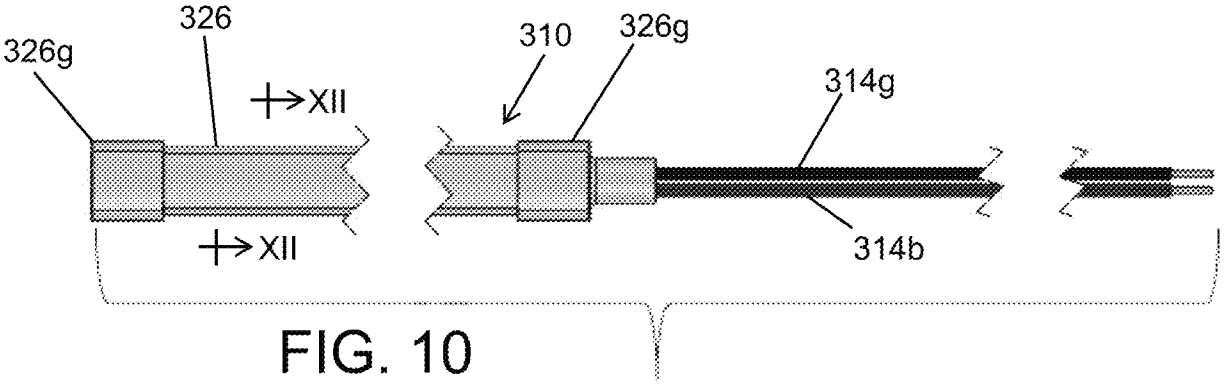
FIG. 10 is a plan view of a fourth embodiment of light assembly.
Figure 11:
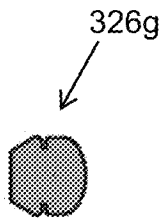
FIG. 11 is an end view of the light assembly of FIG. 10.

Referring to FIG. 10, the numeral 310 designates another embodiment of a light assembly. Similar to light assemblies 10, 110, and 210, light assembly 310 includes a plurality of longitudinally spaced light sources, such as LEDs, which are, for example, connected in series, and mounted on a printed light circuit board 314, with resistors and electrical leads 314*a*, 314*b* for coupling the light sources to a power source, which is enclosed therein by end caps 326*g*, similar to end caps 226*g* described above.

Similar to the previous embodiments, light circuit board 314 may comprise a flexible circuit board, such as a flexible tape light circuit board whose length can be adjusted by cutting the tape at preset cut locations along its length, as would be understood by those skilled in the art. For further details of the light circuit board and an optional control circuit board (which may be enclosed in enclosure 326 as well), reference is made to the above embodiments.

In the illustrated embodiment, light assembly 310 includes an extruded enclosure 326 formed form a flexible material, such as silicone, in which circuit board 314 is inserted. The material forming enclosure 326 may be clear, translucent, or opaque as described above.

Figure 12:
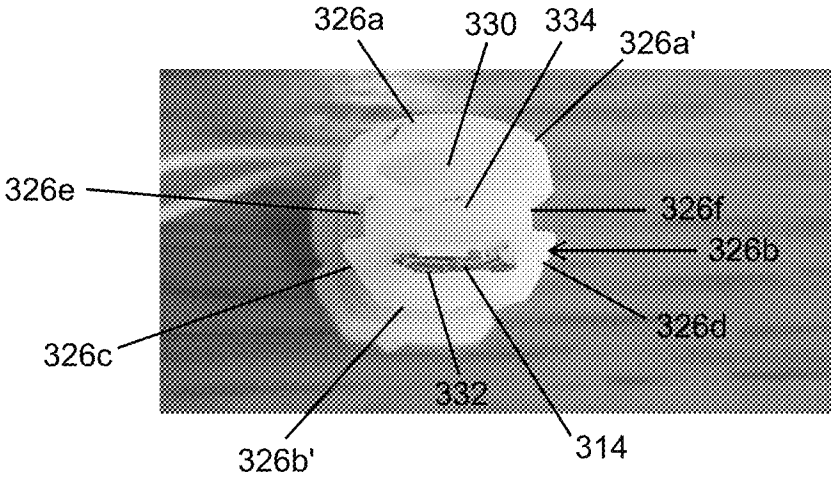
FIG. 12 is a cross-section view taken along line XII-XII of FIG. 10.

Referring to FIG. 12, enclosure 326 has a hollow cross-section with a curved upper wall 326*a* and generally trapezoidal base 326*b*. Curved upper wall 326*a* forms a curved upper surface 326*a*', which in the illustrated embodiment forms the light emitting surface. Trapezoidal base 326*b* includes angles sides 362*c* and 362*d* and a planar bottom surface 326*b*', which may form a bearing surface or mounting surface.

Upper wall 326*a* may have a uniform thickness or may have a varying thickness to adjust the amount of light emitted across its light emitting surface. For example, where the upper wall has an increased thickness at its apex with reduced thickness (e.g. tapered) sides, light through the apex would therefore be more diffused. Given the directional nature of LEDS, this can result in more light being emitted from the sides of enclosure 326 that would otherwise be emitted to provide a more uniform light emission.

In the illustrated embodiment, the opposed angled sides 326*c* and 326*d* of base 326*b* include inwardly projecting, longitudinal grooves 326*e* and 326*f*. Grooves 326*e* and 326*f* are located above bottom surface 326*b*' and provide guides to slide and retain light assembly 310 in a generally C-shaped mounting channel-shaped member (not shown) for mounting light assembly 310, similar to the previous embodiment.

As noted above, light emitting surface 326*a*' is arcuate and, further, together with the material of the enclosure above circuit board 314 form a lens to shape or diffuse the light emitted from the light sources. For examples of suitable ranges of the light emitting surface reference is made to the above embodiments.

In the illustrated embodiment, enclosure 326 includes two channels 330, 332, which are divided by an internal wall 334. Channel 330 is located above wall 334 and above circuit board 314 to provide additional flexibility to light assembly 310. Additionally, channel 330 provides a space to allow some of the light emitted from light sources to be internally reflected, which may produce a more uniform, diffused light output from the light assembly. Internal wall 334 may also assist in further diffusing the light emitted by light assembly 310.

Circuit board 314 is inserted into the second channel 332 beneath internal wall 334 and may be sealed therein by silicone fill, as described above. Alternately, circuit board 314 may be co-extruded with enclosure 326

Similar to the previous embodiment, light circuit board 314 may have through holes formed therein at the cut locations to provide powered indications of where the cut lines are located. Alternately or in addition, as described below, the material, or at least a portion of the material, forming the bottom or back side of the enclosure may be transparent to provide a visual indication of where the cut locations are located.

Figure 13:
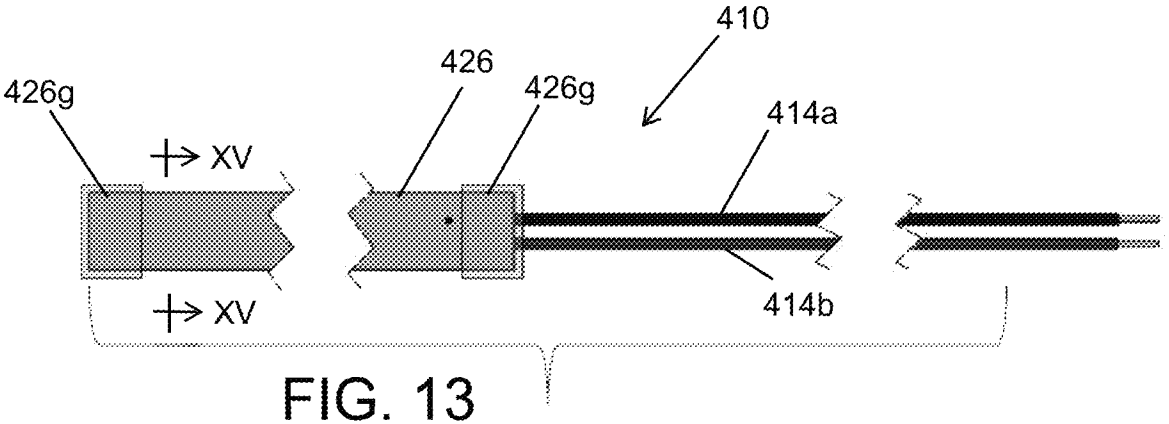
FIG. 13 is a plan view of a fifth embodiment of a light assembly.
Figure 14:
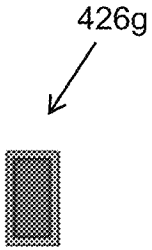
FIG. 14 is an end view of the light assembly of FIG. 13.

Referring to FIG. 13, the numeral 410 designates another embodiment of a light assembly. Similar to light assemblies 10, 110, 210, and 310, light assembly 410 includes a plurality of longitudinally spaced light sources 412, such as LEDs, which are, for example, connected in series, and mounted on a printed light circuit board 414, with resistors and electrical leads 414*a*, 414*b* for coupling the light sources to a power source, which is enclosed therein by end caps 426*g*, similar to end caps 226*g* described above but with a rectangular cylindrical cross-section to match the cross-section of enclosure 426.

Similar to the previous embodiments, light circuit board 414 may comprise a flexible circuit board, such as a flexible tape light circuit board whose length can be adjusted by cutting the tape at preset cut locations along its length. For further details of the light circuit board and an optional control circuit board (which may be enclosed in enclosure 426 as well), reference is made to the above embodiments.

In the illustrated embodiment, light assembly 410 includes an extruded enclosure 426 formed form a flexible material, such as silicone, in which circuit board 414 is inserted. The material forming enclosure 426 may be clear, translucent, or opaque, as noted above.

Figure 15:
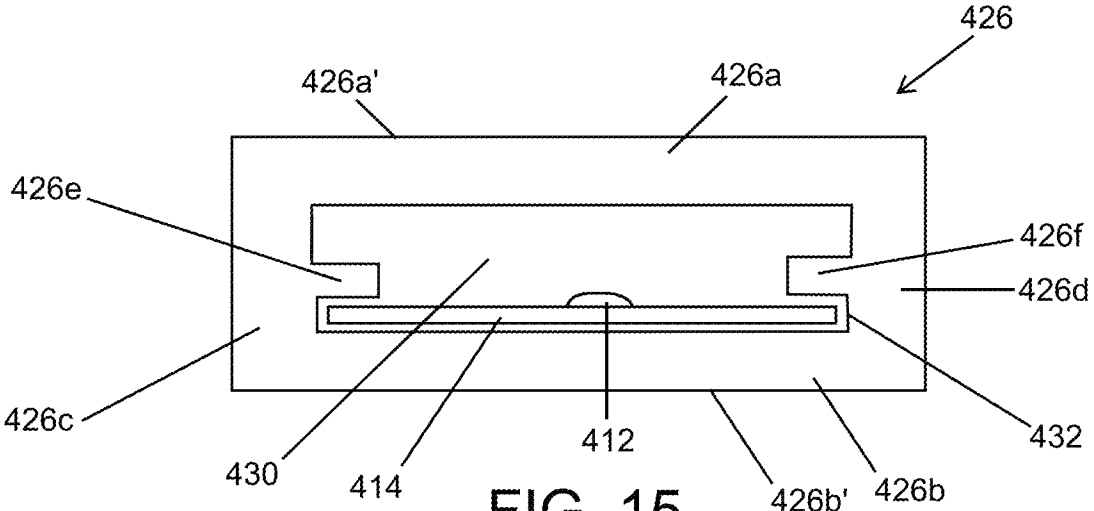
FIG. 15 is a cross-section view taken along line XV-XV of FIG. 13.

Referring to FIG. 15, enclosure 426 has a hollow rectangular cross-section with a flat or planar upper wall 426*a* that forms a planar light emitting surface 426*a*' and a planar bottom or base wall 426*b*, with a lower surface 426*b*', which may form a bearing surface or mounting surface. Upper wall 426*a* may have a uniform thickness or may have a varying thickness to adjust the amount of light emitted across its light emitting surface. For example, an increased wall thickness, for example in the middle, would diffuse the light more than the thinner portions of the wall. Given the directional nature of LEDS, this can result in more light being emitted from the thinner regions to provide a more uniform light emission.

In the illustrated embodiment, enclosure 426 includes two channels 430 and 432, vertically stack and partially separated by flanges 426*e* and 426*f* that project inwardly from side walls 426*c* and 426*d* above base wall 426*b*. Light circuit board 414 is inserted into channel 432 beneath flanges 426*e* and 426*f*, which help retain circuit board 414 in place. Optionally, silicone fill may be inserted into at least channel 432 to further assist in anchoring the circuit board in channel 432. Alternately, circuit board 414 may be coextruded with enclosure 426.

Flanges 426*e* and 426*f* are sized so that they extend only partially cover the spaced opposed longitudinal edges of circuit board 414 so as not to interfere with the light emitted by lights 412, which are located beneath and between the opposed distal edges of flanges 426*e* and 426*f*.

Channel 430, which is located above flanges 426*e* and 426*f*, and above circuit board 414, can provide additional flexibility to light assembly 410. Additionally, channel 430 provides a space to allow some of the light emitted from light sources to be internally reflected, which may produce a more uniform, diffused light output from the light assembly.

Similar to the previous embodiments, light circuit board 414 may have through holes formed therein at the cut locations to provide powered indications of where the cut lines are located. Alternately or in addition, as described below, the material, or at least a portion of the material, forming the bottom or back side of the enclosure may be transparent to allow a visual indication of the cut locations.

Figure 16:
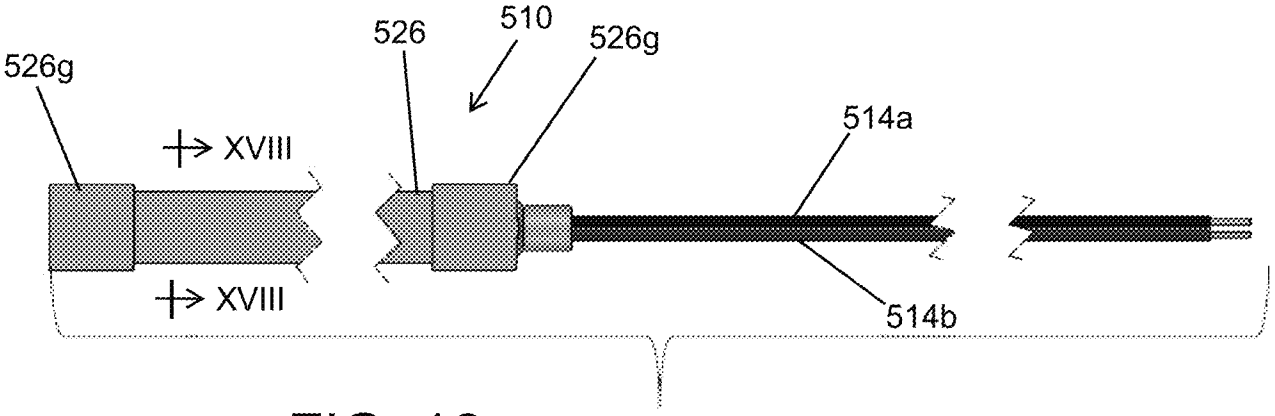
FIG. 16 is a plan view of a sixth embodiment of a light assembly.
Figure 17:
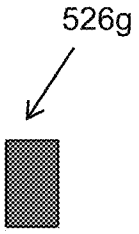
FIG. 17 is an end view of the light assembly of FIG. 16.

Referring to FIG. 16, the numeral 510 designates another embodiment of a light assembly. Similar to light assemblies 10, 110, 210, 310, and 410, light assembly 510 includes a plurality of longitudinally spaced light sources 512, such as LEDs, which are, for example, connected in series, and mounted on a printed light circuit board 514, with resistors and electrical leads 514*a*, 514*b* for coupling the light sources to a power source. Circuit board 515 is also enclosed in enclosure 526 by end caps 426*g*, similar to end caps 226*g* described above, but with a rectangular cylindrical cross-section to match the cross-section of enclosure 526.

Similar to the previous embodiments, light circuit board 514 may comprise a flexible circuit board, such as a flexible tape light circuit board whose length can be adjusted by cutting the tape at preset cut locations along its length. For further details of the light circuit board, cut locations, and an optional control circuit board (which may be enclosed in enclosure 426 as well), reference is made to the above embodiments.

In the illustrated embodiment, light assembly 510 includes an extruded enclosure 526 formed form a flexible material, such as silicone, in which circuit board 514 is inserted or coextruded. However, in the illustrated embodiment, enclosure 526 is formed from at least two materials, either the same or similar materials but with different opacity to control where the light from lights sources 512 is emitted and, further, to provide a window or windows to see the cut locations, more full described below. For example, suitable materials include silicone or a flexible polyvinyl chloride (PVC).

Figure 18:
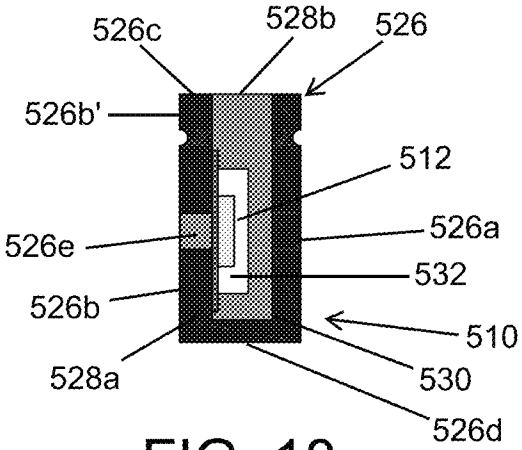
FIG. 18 is a cross-section view taken along line XXVIII-X VIII of FIG. 16.

Referring to FIG. 18, enclosure 526 has a rectangular cross-section with a channel formed therein for circuit board 514, flat or planar upper wall 526*a*, a planar bottom or base wall 526*b*, with a lower surface 526*b*', which may form a bearing surface or mounting surface. In the illustrated embodiment, the light emitting surface is formed by side wall 526*c*. To direct the light from light sources 512 through side wall 526*c*, upper wall 526*a* is formed from an opaque material, such as an opaque silicone, so that light is internally reflected back into enclosure 526. For example, the material forming at least a portion of upper wall 526*a* may include an additive, such as dark color pigments, to block the transmission of light through the upper wall 526*a*. Side wall 528*b*, on the other hand, is at least partially formed from a light transmitting material, such as silicone, which may include a light diffusing agent or agents, such as powdered organic resins, including poly(meth)acrylate resin, polystyrene resin or (meth)acrylate-styrene copolymer microparticulates or other microparticulates, and further may include an additive in the form of a light color pigment.

In the illustrated embodiment, enclosure 526 also includes at least a region 526*e* of the light transmitting material at base wall 526*b*. Region 526*e* allows a user to see the underside of circuit board 514 and, more specifically, the cut locations along circuit board 514.

Upper wall 526*a* may have a uniform thickness or may have a varying thickness to adjust the internal reflections of the light from light sources 512. In the illustrated embodiment, upper wall 526*a* is formed by a leg of a U-shaped body 528*a* of the light blocking material, which also forms at least portion of the wall of opposed side 526*d* of enclosure 526. Located in the channel 530 formed in light blocking U-shaped body 528*a* is an inverted U-shaped body 528*b* of the light transmitting material, which forms as noted above, a portion of side wall 526*c* and also straddles circuit board 514. Additionally, the body forming enclosure 526 includes a region or strip of the light transmitting material in base wall 526*b*, which forms the light transmitting portion 526*e* that allows a visual indication of the cut locations.

In this manner, light emitted from light sources 512 is directed into the channel 532 formed by light transmitting U-shaped body 528*b*, which then is directed into light transmitting body 528*b* and then internally reflected by light blocking body 528*a* to be emitted through side 526*c*.

Figure 19:
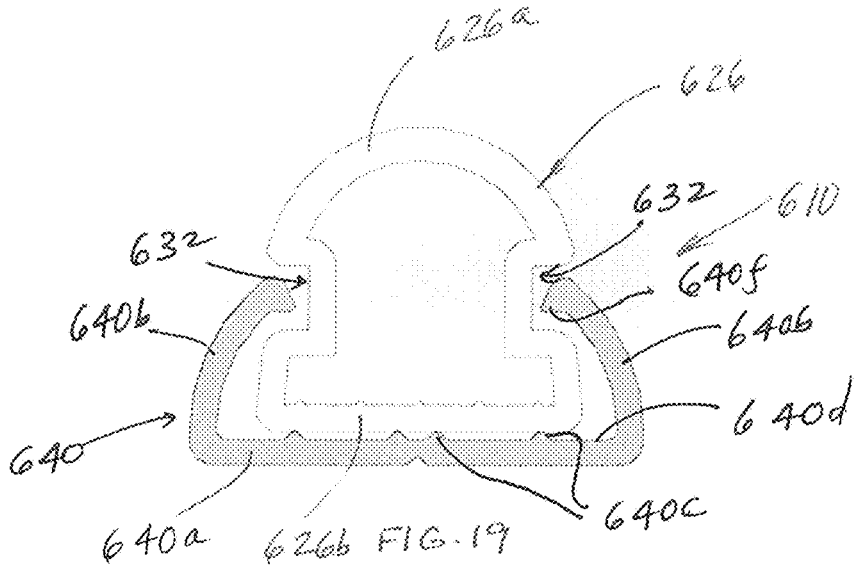
FIG. 19 is an end view of another embodiment of a light assembly (with the light circuit board removed) shown mounted in a mounting channel-shaped member or clip.
Figure 20:
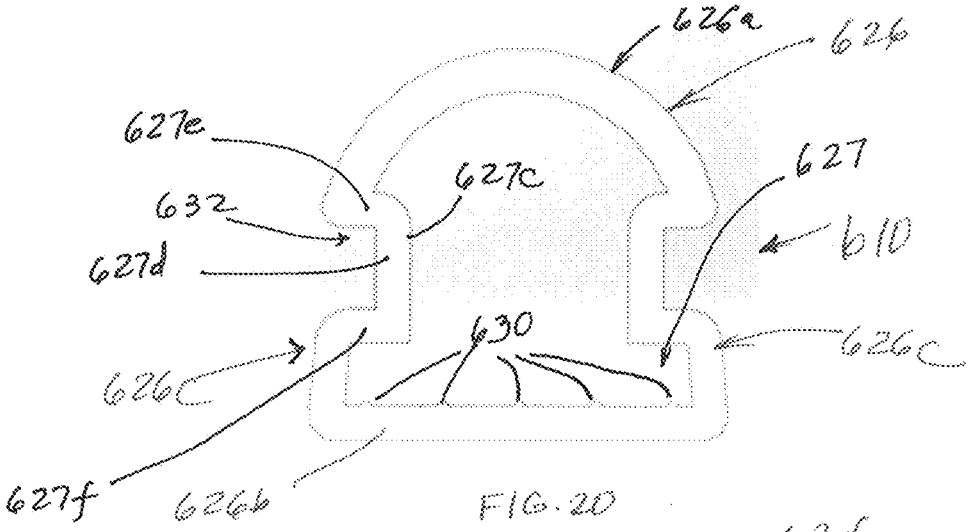
FIG. 20 is an end view of the light assembly of FIG. 19 removed from the mounting channel-shaped member or clip
Figure 21:
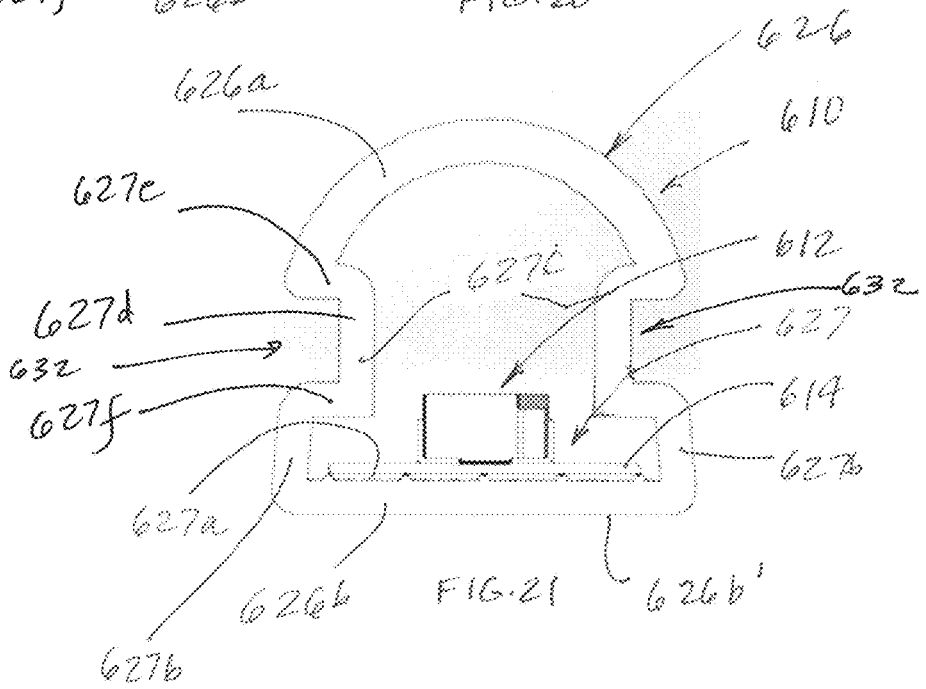
FIG. 21 is a similar view to FIG. 20 with a light circuit board.

Referring to FIGS. 19-21, the numeral 610 another embodiment of a light assembly. Similar to the above described light assemblies, light assembly 610 includes a plurality of longitudinally spaced light sources 612, such as LEDs, which are connected, for example, in series, and mounted on a printed light circuit board 614, with resistors and electrical leads (see previous embodiment for detail) for coupling the light sources to a power source, which together form a light circuit for the light assembly.

Similar to the previous embodiments, light circuit board 614 may comprise a flexible circuit board, such as a flexible tape circuit board whose length can be adjusted by cutting the tape at preset cut locations along its length. Additionally, the length of light assembly 610 may be adjusted and provide visibility of the cut lines of the circuit board 614 through the enclosure as described above and below. For further details of the circuit board 614, cut locations, and an optional control circuit board, reference is made to the above embodiments.

In the illustrated embodiment, light assembly 610 includes a flexible elongated enclosure 626, such as an extruded flexible elongated enclosure, formed form a flexible material, such as flexible polyvinyl chloride (PVC) or silicone, in which light circuit board 614 is inserted or coextruded. In this manner, light assembly 610 is a flexible light assembly suitable for a wide range of applications. Enclosure 626 may be made from a transparent or translucent flexible material, and may include regions of opaque material to control the location and size of the light emitting surface, as described above.

Referring again to FIGS. 19 and 21, enclosure 626 has an upper wall 626*a*, a bottom or base wall 626*b* (which may form a base) with a lower surface 626*b*', which may form a bearing surface or mounting surface. For example, lower surface 626*b*' may have a double sided tape applied thereto so that light assembly 610 may be mounted directly on a surface or may be inserted into a mounting member or members, such as one or more clips or one or more mounting channel-shaped members, described more fully below, to mount the light assembly to a surface.

In one embodiment, the lower surface of the base wall of the enclosure is planar, or at least has a planar portion, to allow the flexible light assembly to be mounted to a flat surface using an adhesive, such as two-sided adhesive tape, applied the base wall, as noted above. Optionally, base wall 626*b* may have a curved lower surface to accommodate mounting on a curved surface or alternately may have one or a plurality of parallel longitudinally extending grooves formed therein to allow the base wall to bend or flex to customize the shape of the base wall to provide a better fit up when mounting on a non-planar surface.

In the illustrated embodiment, upper wall 626*a* extends over and is integrally formed with the ends of a pair of opposed side walls 626*c*. Flexible elongated enclosure 626 also includes a channel 627 formed therein, formed by the upper side 627*a* of base wall 626*b*, between lower portions 627*b* of side walls 626*c*, and beneath inwardly offset portions 627*c* of side walls 626*c*, more fully described below.

To provide increased airflow between light circuit board 614 and upper side 627*a* of base wall 626*b* of flexible elongated enclosure 626, channel 627 includes one or more supports 630. In the illustrated embodiment, channel 627 includes a plurality of supports 630, but as will be described below in reference to FIG. 25, for example, channel 627 may include a single support 630. Supports 630 optionally extend along the full length of the enclosure 626 (i.e. along the longitudinal axis, see FIG. 19B to see illustration of the elongated nature and length of the enclosure) so that they form ribs that provide support for the full length of the enclosure, which can reduce the friction between the light circuit board and the base wall of enclosure 626, which can facilitate installation of the light circuit board when the circuit board is inserted from one end of the enclosure.

Supports 630 may be formed from additional material added to base wall 626*b* during the forming process, typically an extrusion process, to form projections from base wall 626*b* so that the thickness of the base wall is locally increased over a discrete region or regions where the support or supports 630 are located. The size and shape of the cross-section of the supports may vary and may include curved shapes, such a semicircular or arched, or multi-sided shapes, such as triangular, rectangular, trapezoidal, hexagonal, for example.

The height of the support or supports is sufficient to create a space, for example, that forms an air gap or falls in a range of about 0.1 to 1.5 mm to allow airflow between the bottom surface of light circuit board and the upper side of base wall. For example, therefore a suitable height of the support is about 0.1 to 1.5 mm. In addition to providing space between the bottom surface of light circuit board and the upper side of base wall, support or supports provide a guide surface (and reduce friction) along which the light circuit board 614 can be guided when inserted into the elongated enclosure 626.

The width of the supports 630 may also vary. For example, the width of each of the supports may be fall in a range of about 0.1 mm to 8 mm, and the spacing between the supports may vary and, for example, may fall in a range of 0.1 mm to 8 mm to allow the bottom surface of the circuit board 614 to be at least visible through base wall 626*b* between the supports.

Additionally, supports 630 can reduce the space between the circuit light board 614 and the retention structures formed by the offset portions 627*c* of the side walls 626*c* to restrict movement of the light circuit board 614, while still maintaining the size of the channel large enough to facilitate installation and to provide air circulation around the light circuit board for cooling of the light circuit board 614.

Further, as noted, by spacing supports 630 along with the width of the enclosure 626, the increased thickness of the base wall may be localized so the light circuit board 614 is still visible though the base wall between the supports. Depending on the height of the supports, the bottom surface of light circuit board 614 may still be visible through the supports as well.

In another embodiment, the base wall 626*b* of enclosure 626 may be formed with a generally constant thickness even in the locations of the supports 630 by forming the supports from offsets (versus projections) in the base wall or by simply reducing the material in the base wall 626*b* below the supports 630 (e.g. by adding metal to the mold in those locations, which forms the extrusion).

In either embodiment, therefore, the space between the light circuit board 614 and the base wall 626*b* of the enclosure may be sufficiently small to allow the bottom surface of the flexible light circuit board 614 to be visible through the base wall of the enclosure at least between the supports, when the enclosure is made from a transparent or translucent material.

As noted above, offset portions 627*c* of side walls 626*c* form retention structures to retain light circuit board 614 in channel 627 and tend to provide a more secure mounting of the light assembly via a mounting member or members, described more fully below. By forming the retention structures from wall offsets rather than protections that extend from the side walls, inconsistencies in the enclosure wall during the extrusion process due to different cooling rates of the different parts of enclosure may be avoided or reduced. However, it should be understood that in some applications, such as described in reference to several embodiments below, variations in wall thickness, such as formed by projections (FIG. 32), may be desirable even with the attendant variations in the enclosure wall.

In the illustrated embodiment, offset portions 627*c* are formed by channel-shaped offsets in side walls 626*c* so that they each include an inwardly spaced vertical leg or web 627*d* and upper and lower flanges 627*e*, 627*f* that connect the offset portions to the lower portions of opposed side walls 626*c* and upper wall 626*b*. Webs 626*d* of offset portions 627*c* are spaced apart so that they do not block the light emitted from light sources 612 but are sufficiently inset from upper wall 626*a* to form recesses 632 for engagement by the mounting members described below.

As best seen in FIG. 21, therefore, light sources 612 are located between offset portions 627*c*, while circuit board 614 is retained in channel 627 below offset portions 627*c*. For example, light sources 612 may emit light over an arcuate range of about 90 to about 180 degrees or about 60 to about 120 degrees. Therefore, as the height of side walls 626*c* are increased some of the light emitted from light sources 612, while not be blocked from offset portions 627*c*, will be reflected off the inwardly facing surface of offset portions 627 and then emitted though upper wall 626*a* of enclosure. This additional reflection of the light will result in more diffusion in the light with the light assembly producing fewer discrete points of light ("hot spots") and, instead, creating a light that appears more light a neon light effect where the light enclosure glows.

By the same token, when height of side walls 626*c* are decreased all of the light emitted from light sources 612 will be direct to the inner surface of upper wall 626*a* so that the light emitted from individual lights sources may be detected (create "hot spots"), depending on the spacing of the light sources—the more spaced the light sources, the more discrete the lights appear.

Upper wall 626*a* may have a uniform thickness or may have a varying thickness to vary the diffusion of the light through upper wall 626*a* across the width of the enclosure. Similarly, side walls 626*c* and, in some embodiments, the base wall 626*a* may each have a uniform thickness. In the illustrated embodiment, upper wall 526*a* is a curved wall, such as an arcuate wall, as noted with a uniform thickness. At least upper wall 626*a* (an optionally just a portion of upper wall) forms a light output surface, though it should be understood that by varying the enclosure material, the inner surface of the enclosure, the height of the enclosure (or space between the light surfaces and the upper wall), and/or the location of the light sources, the light emitted from the flexible enclosure may vary, as well as which portions of the enclosure wall form a light emitting surface or light emitting surfaces, as will be more fully described below.

As would be understood, the thicker the upper wall, the more the light is diffused. Therefore, when the upper wall has the thinnest wall thickness at the apex of the curved wall, but then increases in thickness (e.g. uniformly) as you move down the upper wall from either side of the apex to the intersections with side walls 626*c*, the light emitted from light enclosure will be the most intense at the apex and gradually reduce its intensity across the width of the enclosure the further you are spaced from the apex.

Therefore, to vary the characteristic of the light emitted from the enclosure, in some embodiments, the upper wall may have a variable wall thickness to vary the output of the light through the light emitting surface across the width of the enclosure. For example, as noted, the variable wall thickness may uniformly increase from the apex of the upper wall 626*a* to its intersection with side walls 626*c* such that the apex of the upper wall has the thinnest wall cross-section, and the lowest opposed sides of the upper wall 626*a* that form the light output surface have the greatest thickness.

As noted above, offset portions 627*c* of side walls 626*c* may form recesses 632 to provide engagement structures for one or more mounting members 640. In the illustrated embodiment, mounting member 640 has a C-shaped cross-section with a bottom or base wall 640*a* and two opposed flanges 640*b* that extend upwardly from the base wall to thereby form a channel there between for receiving the flexible elongated enclosure 626. The opposed flanges 640*b* of the mounting member are spaced apart and extend into the recesses 632 of the flexible elongated enclosure 626. This can be done by inserting enclosure 626 into the channel from one end of the channel or by pressing the enclosure between the flanges, for example, when the mounting member is sufficiently flexible, such as when made from plastic. When made from metal, such as aluminum, the flanges may be too rigid to flex and instead require the enclosure to be slid into the member 640 from one end as noted above.

Figure 19A:
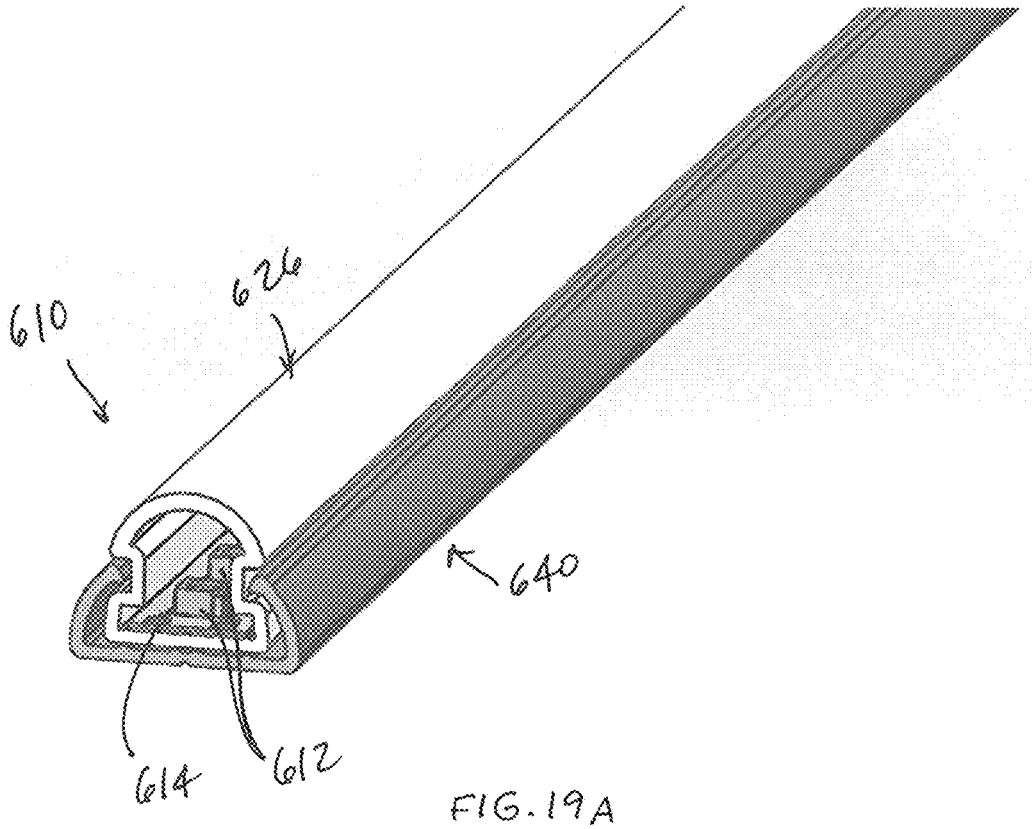
FIG. 19A is a perspective view of the light assembly of FIG. 19 shown with a mounting channel shaped member.
Figure 19B:
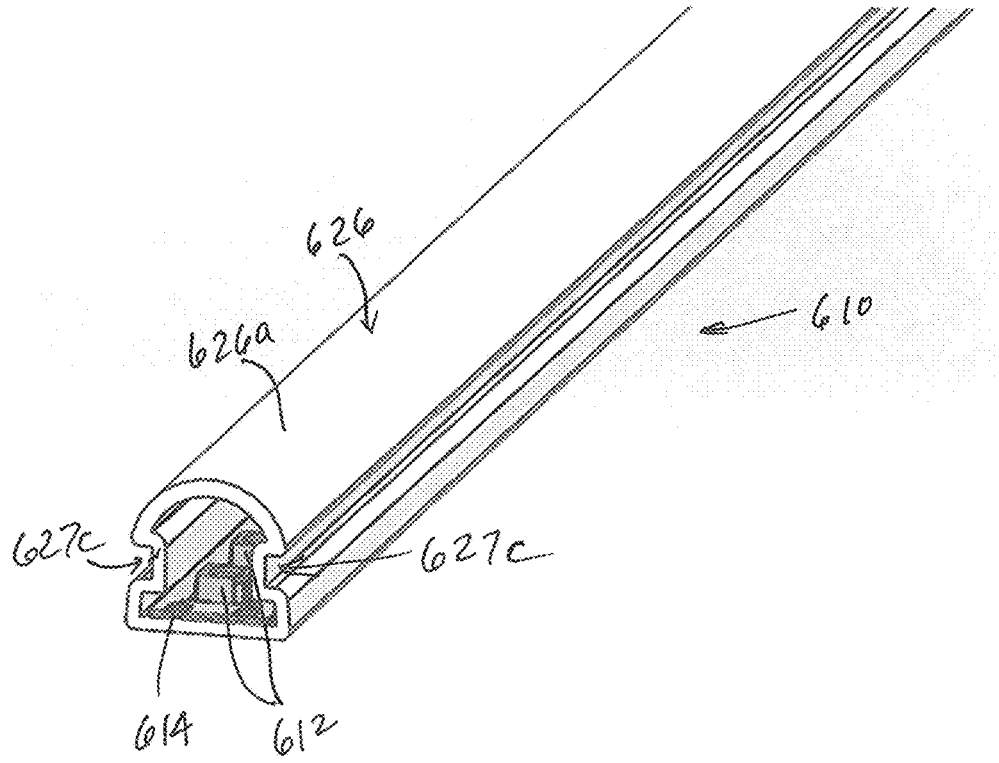
FIG. 19B is a perspective view of the light assembly of FIG. 19 removed from the mounting channel-shaped member.

In the illustrated embodiment, mounting member 640, therefore, engages enclosure 626 below upper wall 626*a* and, hence, below the light output surface of enclosure 626 and therefore does reduce the light output of the flexible light assembly. As noted above, mounting member 640 may be configured as a clip or elongated channel-shaped member, such as shown in FIG. 19A.

Optionally, base wall 640*a* may include one or more projecting ribs 640*c* formed on upper surface 640*d* of base wall 640*a* thereon to form guides (and to reduce friction) to facilitate sliding installation of enclosure 626 into the mounting member, especially when configured as an elongated mounting channel-shaped member. For further details not expressly described in reference to enclosure 626, reference is made to the other embodiments disclosed herein.

Figure 22:
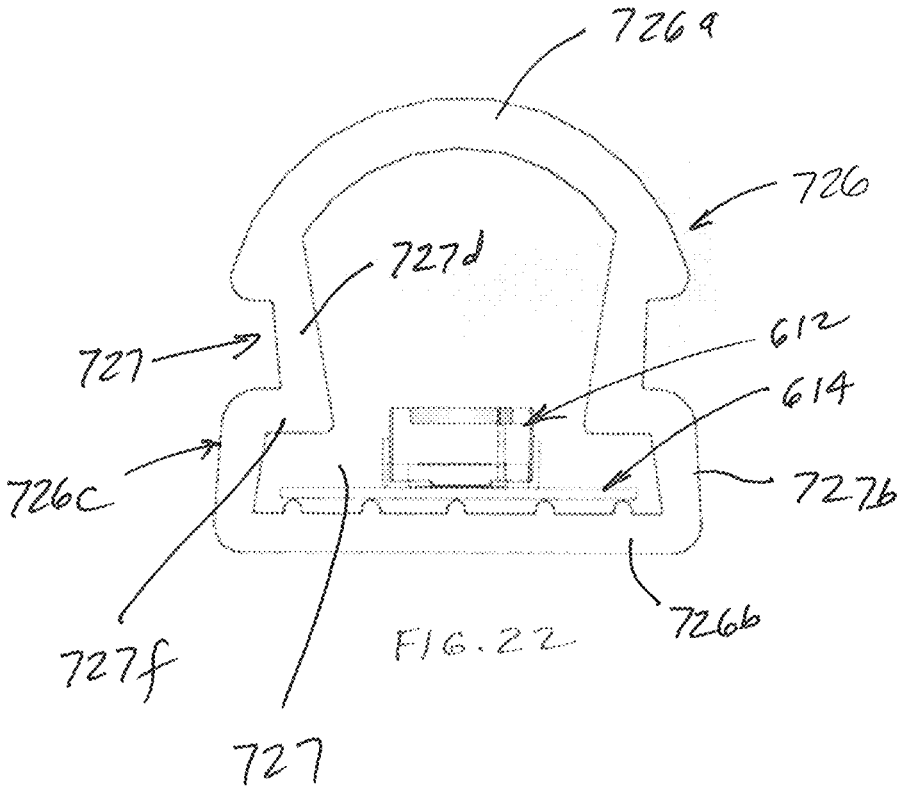
FIG. 22 is an end view of another embodiment of a light assembly with a light circuit board.
Figure 23:
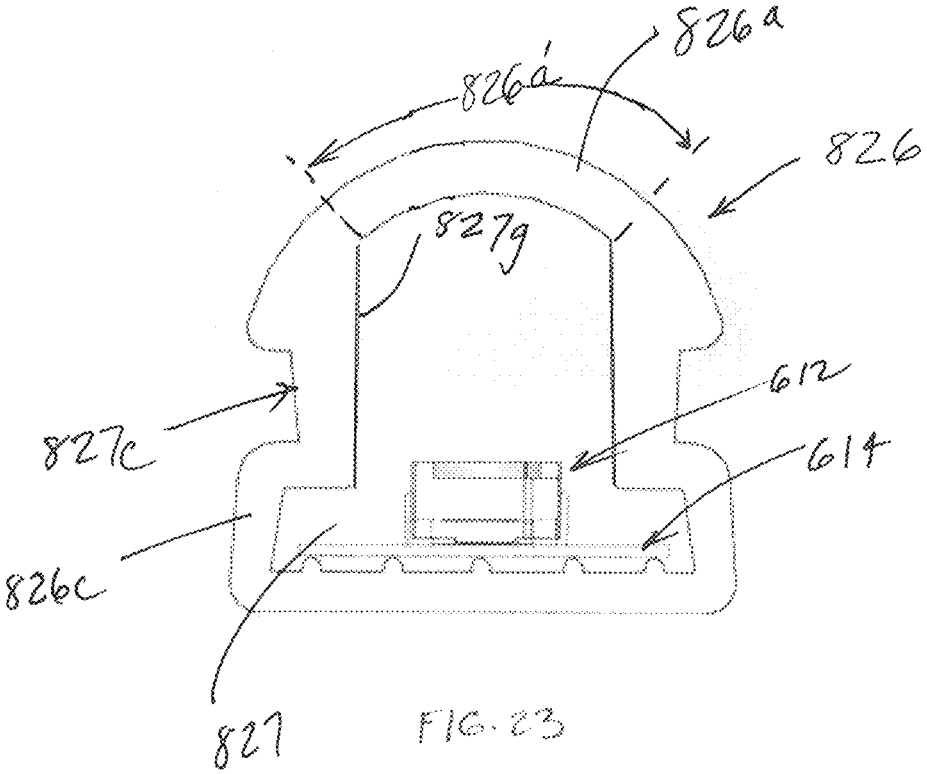
FIG. 23 is an end view of another embodiment of a light assembly with a light circuit board.

Referring to FIGS. 22 and 23, the elongated enclosures of the light assembly may vary. For example, as best seen in FIG. 22 (only cross-section of elongated enclosure is shown), enclosure 726 includes a plurality of light sources 612 mounted to a light circuit board 614 similar to those described above and a similar cross-section to enclosure 626 except that side walls 726*c*, rather than each having a uniform thickness each may have a variable wall thickness.

In the illustrated embodiment, offset portions 727*c* of side walls 726*c* have a generally L-shape (and reverse L-shaped) with a generally vertical leg or web 727*d* that varies in thickness, tapering and widening in thickness from its upper end where it intersects with upper wall 726*a* to its lower end wherein flange 727*f* extends from web 727*d* to join with lower portion 727*b* of side wall 726*c*.

Similarly, lower portion 727*b* of side wall 726*c* may also vary in thickness, and, for example, taper downwardly from flange 727*f* to base wall 726*b* so that their inner surfaces are angle relative to base wall 726 to facilitate retention of the light circuit board 614 in channel 727.

In this manner, the width of the interior of enclosure 726 between webs 727*d* expands through the height of the side walls 726*c* and together with inner surface of upper wall 726*a* form a rounded wedge shaped interior space above light sources 612. In this manner, offset portions 727*c* also do not block the light from light sources 612 and, further, more of or all of the light emitted from light sources 612 may directly pass through upper wall 726*a* than in the previous embodiment (assuming the same enclosure height and range of output from the light sources).

Additionally, the width of channel 727 widens toward base wall 726*b*, as noted above, which helps retain light circuit board 614 in channel 727.

For further details of light sources 612, light circuit board 614, and optional supports 630 that may be provided in channel 727 of enclosure 726 reference is made to the above description. For further details not expressly described in reference to enclosure 726, reference is made to the other embodiments disclosed herein.

Referring to FIG. 23 (only cross-section of elongated enclosure is shown), enclosure 826 is similar to enclosure 726 except that offset portions 827*c* of side walls 826*c* are each formed so that their interior surfaces 827*g* are generally vertical and parallel and, further, intersect with upper wall 826*a* inwardly from the ends of upper wall. In this manner, the light emitting surface 826*a*' of upper wall 826*a* may be reduced in its angular range, but may produce a more intense light given that more light may be directed through the narrow angular range.

Depending on the intensities of light sources 612 and the material forming enclosure 826, light emitting surface 826*a*' may form a primary light emitting surface and enclosure 826 may include secondary light emitting surfaces 826*a*" that straddle on either side of light emitting surface 826*a*', which produce more diffused light than primary light emitting surface 826*a*'. For further details of light sources 612, light circuit board 614, and optional supports 630 that may be provided in channel 827 of enclosure 826 reference is made to the above description. For further details not expressly described in reference to enclosure 826, reference is made to the other embodiments disclosed herein.

Figure 24:
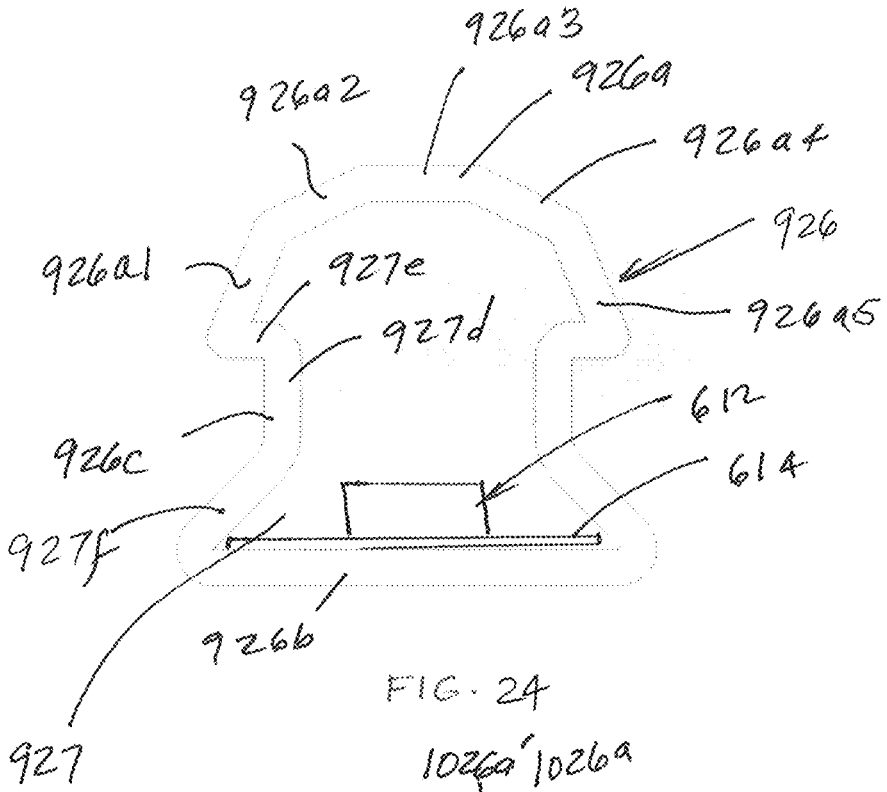
FIG. 24 is an end view of another embodiment of a light assembly.
Figure 25:
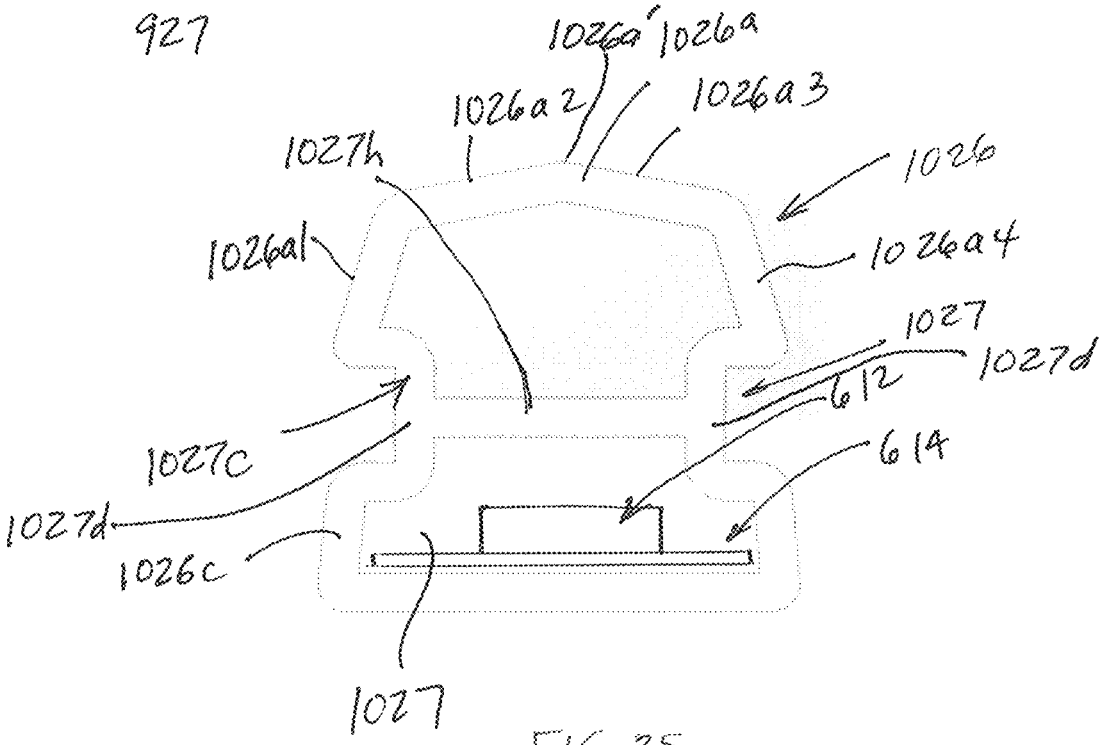
FIG. 25 is an end view of another embodiment of a light assembly.

Referring to FIGS. 24-25 (only cross-section of elongated enclosure is shown), as noted above, the enclosure may have an upper wall with a non-curved cross-section and instead have a plurality of planar sections. As best seen in FIG. 24, enclosure 926, includes an upper wall 926*a* with a plurality of planar segments 926*a*1, 926*a*2, 926*a*3, 926*a*4, and 924*a*5, with segment 926*a*3 being generally horizontal and straddled by segments 926*a*2 and 926*a*4, which are both angled downwardly from segment 926*a*3. Angled downwardly from segments 926*a*2 and 926*a*4 are segments 926*a*1 and 926*a*5. Optionally, each segment has the same thickness, but it should be understood that their thicknesses may vary depending on the desired characteristics of the light output of the light assembly.

Further, in the illustrated embodiment, side walls 926*a* each have an offset portion 927 that has a generally trapezoidal shape with a vertical leg or web 927*d*, an upper horizontal flange 927*e* that extends from web 927*d* and intersects with upper wall 926*a*, and an angled lower flange 927*f* that extends from web 927*d* and intersects with base wall 926*b*. Further, side walls 926*c* have a generally uniform thickness. In this manner, the inner surfaces of angled lower flanges 927*f* form retention structures for retaining light circuit board 614 in channel 927.

Similar to enclosure 726 and 826, channel 927, therefore, widens towards base wall 926*b*. For further details not expressly described in reference to enclosure 926, reference is made to the other embodiments disclosed herein.

Referring to FIG. 25 (only cross-section of elongated enclosure is shown), enclosure 1026 is similar to enclosure 626 but includes a segmented upper wall 1026*a* (similar to enclosure 926). Upper wall 1026*a* includes a plurality of planar segments 1026*a*1, 1026*a*2, 1026*a*3, and 1026*a*4, with segments 102*a*2 and 1026*a*3 being angled relative to each other and forming an apex 1026*a*' at their juncture.

Side walls 1026*c* also include C-shaped offset portions 1027*c*, similar to offset portions 627*c*, but which are interconnected by a horizontal wall 1027*h* that spans between webs 1027*d* and, further, covers light sources 612. Therefore, light from light sources 612 must pass though wall 1027*h* prior to passing through upper wall 1026*a*, which produces a more even "glow" with minimal "hot spots" (regions of concentrated light that appears as discrete light regions as opposed to a continuous light—or "glow"). For further details not expressly described in reference to enclosure 1026, reference is made to the other embodiments disclosed herein.

Figure 26:
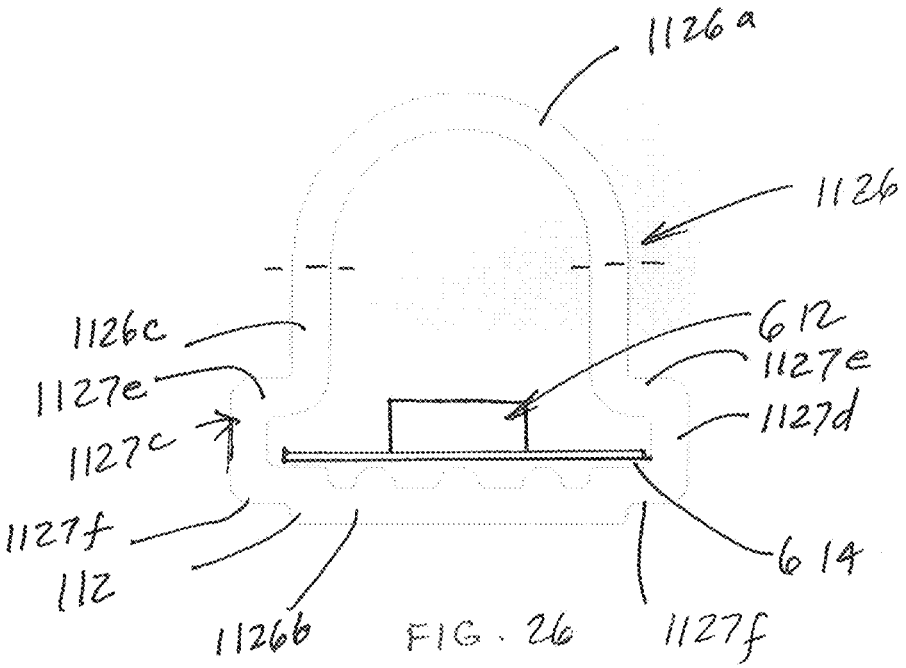
FIG. 26 is an end view of another embodiment of a light assembly.

Referring to FIGS. 26-30 (only cross-section of elongated enclosure is shown), the enclosures may be formed with base walls and channels that are wider than the upper wall, which may provide a different appearance and may in some cases, ease installation and/or reduce costs. Further, with this configuration greater tolerances may be achieved between the enclosure and mounting member(s). As best seen in FIG. 26, enclosure 1126 a dome shaped upper wall 1126*a* that is joined the upper ends of vertical side walls 1126*c*. For clarity, upper wall 112*a* is defined as that portion of the enclosure wall that has a curved outer surface and curved inner surface, with the side walls starting at the point where the outer and inner surface of the enclosure wall become vertical and parallel.

Enclosure 1126 also includes offset portions 1127*c* in side walls 1126*c*, but which are offset outwardly from upper wall 1126*a* rather than inwardly as shown and described above and further are formed at the lower end of side wall 1126*c*. In this manner, as noted, base wall 1126*b* and channel 1127 are wider than upper wall 1126*a*.

Similar to the above described embodiments, base wall 1126*b* may have one or more supports 630 formed thereon or by offsets in base wall 1126*b*. Further, in the illustrated embodiment, offset portions 1127*c* form channel 1127, which is defined between vertical legs or webs 1127*d*, beneath horizontal flanges 1127*e*, and above lower flanges 1127*f*. As a result, upper flanges 1127*e* may form the engagement structure for the mounting members, and flanges 1127*f* may form supports for light circuit board 614 so that supports 630 may be omitted or a single support 630 may be provided between flanges 1127*f* on base wall 1126*b*. For further details not expressly described in reference to enclosure 1126, reference is made to the other embodiments disclosed herein.

Figure 27:
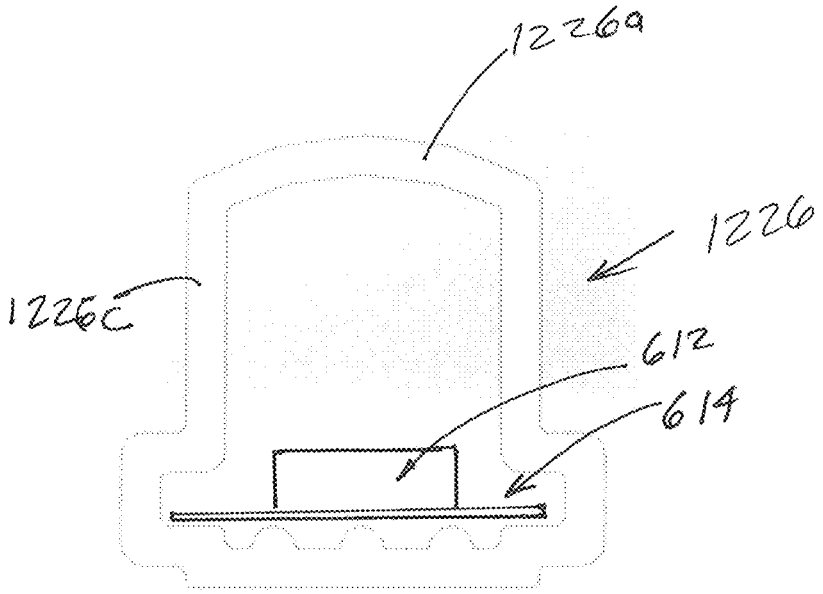
FIG. 27 is an end view of another embodiment of a light assembly.

Referring to FIG. 27 (only cross-section of elongated enclosure is shown), enclosure 1226, which is similar to enclosure 1126, may have a curved upper wall 1226*a*, but which has a larger radius of curvature than upper wall 1126*a* and straddles taller side walls 1226*c* so that more light from light sources 612 is internally reflected off side walls 1226*c* before the light exits upper wall 1226*a*. As a result, light output from enclosure 1226 will also produce a glow effect but over a more discrete radial cross-section (smaller angular range of output) than enclosure 1126 and, further, may produce a sharper definition at the outer edges of the light, which occur at the transition between upper wall 1226*a* and side walls 1226*c*. For further details not expressly described in reference to enclosure 1226, reference is made to the other embodiments disclosed herein.

Figure 28:
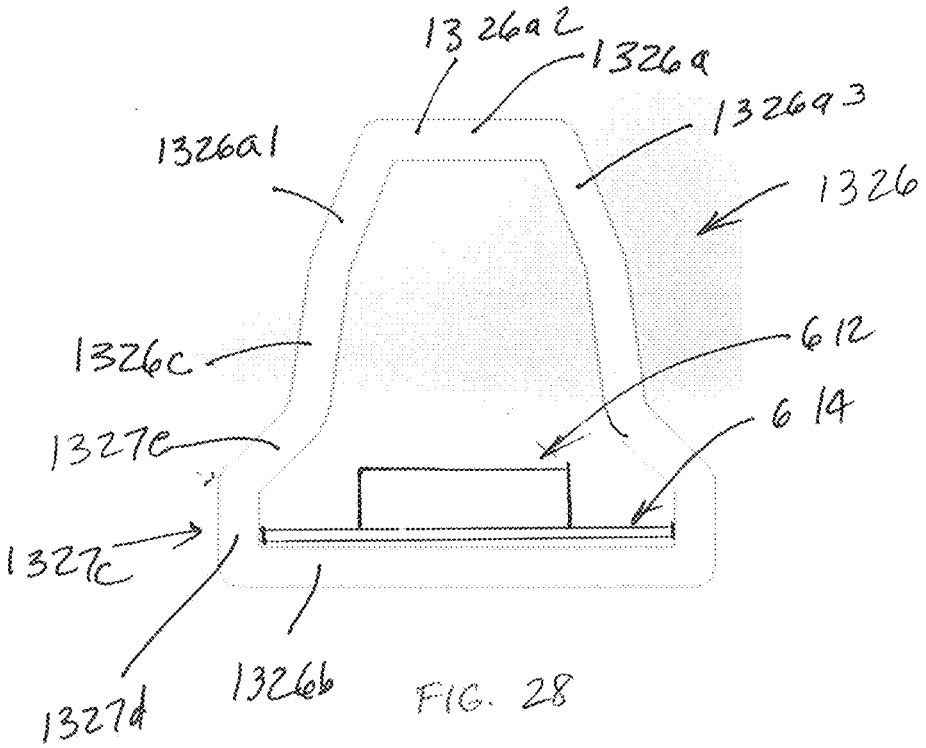
FIG. 28 is an end view of another embodiment of a light assembly.

Referring to FIG. 28 (only cross-section of elongated enclosure is shown), enclosure 1326, which is similar to enclosure 1226, includes a segment upper wall 1326*a*, with three segments 1326*a*1, 1326*a*2, and 1326*a*3, but which are more angled relative to each other than, for example, upper wall 1026*a*. Similar to upper wall 26*a*, upper wall 1326*a* has a central horizontal segment 1326*a*2, flagged by two downwardly angled side segments 1326*a*1 and 1326*a*3. Optionally, each segment has the same thickness, but it should be understood that their thicknesses may vary depending on the desired characteristics of the light output of the light assembly.

In the illustrated embodiment, side walls 1326*c*, while also having uniform thickness, are angled inwardly toward upper wall 1326*a*. As a result, a larger portion of the light emitted from light sources 612 is reflected off side walls 1326*c* towards upper wall 1326*a* than, for example, in enclosure 1226. As a result the light may be more diffused though will be more concentrated though segment 1326*a*2, and as result will demonstrate more light variation across the cross-section of the upper wall than, for example, upper wall 1226*a* of enclosure 1226.

In addition, offset portion 1327*c* of side wall 1327*c*, which is also located at the lower end of side wall 1326*c* (similar to enclosure 1126) includes a upper flange 1327*e* that is angled inwardly and a vertical leg or web 1327*d* that joins with base wall 1326*b* to thereby form the channel 1327. In this embodiment, similar to upper flange 1127*e*, upper flange 1327*e* forms the retention structure for retaining light circuit board 614 in channel 1327.

Although not shown with supports 630, supports 630 may be provided in enclosure 1326. For further details not expressly described in reference to enclosure 1326, reference is made to the other embodiments disclosed herein.

Figure 29:
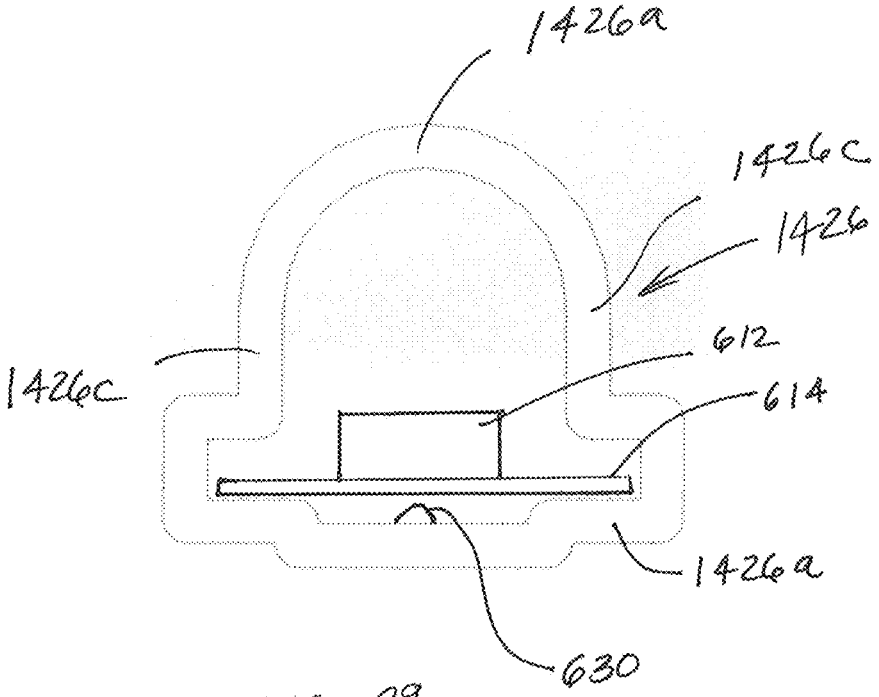
FIG. 29 is an end view of another embodiment of a light assembly.

Referring to FIG. 29 (only cross-section of elongated enclosure is shown), enclosure 1426 is similar to enclosure 1126 but includes shorter side walls 1426*c*; therefore, lights 612 are spaced closer to upper wall 1426*a* than, for example, enclosure 1126, which tends to produce a discrete light pattern where the individual lights can be seen—in other words, it creates more "hot spots". For further details not expressly described in reference to enclosure 1426, reference is made to the other embodiments disclosed herein.

Figure 30:
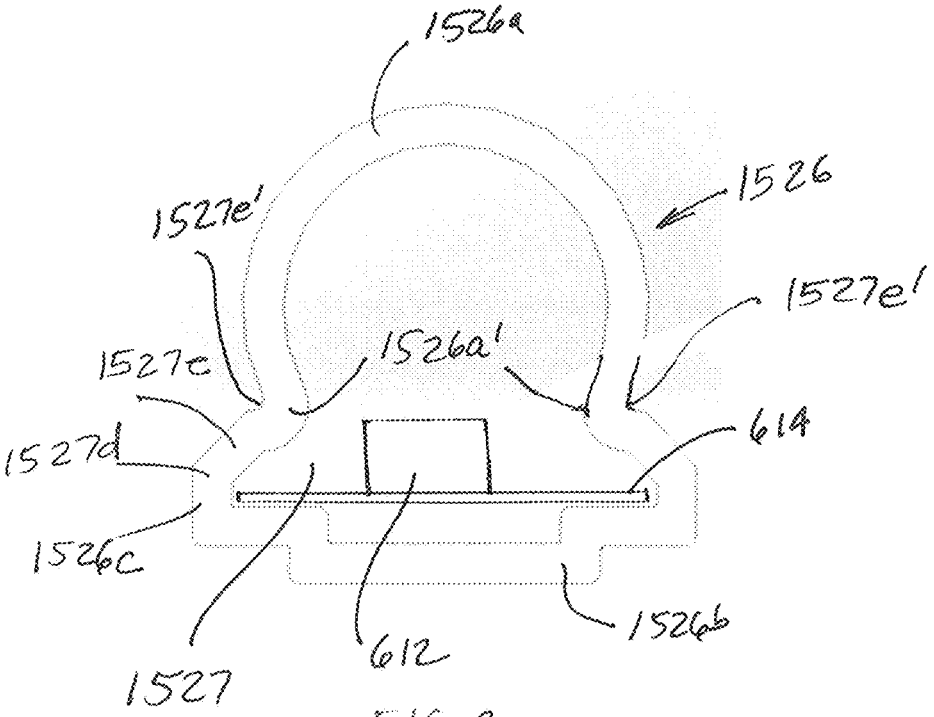
FIG. 30 is an end view of another embodiment of a light assembly.

Referring to FIG. 30 (only cross-section of elongated enclosure is shown), enclosure 1526, which is also similar to enclosure 1126, includes a rounded upper wall 1526*a*, which increases the angular range of the light output from the light emitting surface of the upper wall and further tends to disperse the light more evenly through upper wall 1526*a* to eliminate any light variations across the light emitting surface of the enclosure.

In the illustrated embodiment, the side walls 1526*c* are generally trapezoidal in shape (through their cross-sections) with angled upper flanges or wall portions 1527*e*, which connect to the opposed ends 1526*a*' of upper wall, and vertical portions 1527*d* that join to base wall 1526*b* via horizontal flanges 1527*f*. In this manner, similar to the previous embodiments, side walls 1527*c* forms the channel 1527 for receiving light circuit board 614 and retaining upper circuit board 614 in channel 1527 via angled upper flanges or wall portions 1527*e*. In addition, the outward offsets of vertical wall portions 1527*d* form engagement structures for the mounting members described above. Optionally, small recesses or notches 1527*e*' may be formed at the juncture of flanges 1527*e* and upper wall 1526*a* to provide additional engagement structures and provide an enhanced mechanical interlocking arrangement or interface between the mounting member and the enclosure, especially where the mounting member includes lips 640*f* at the end of the opposed flanges 640*b* (see FIG. 19). For further details not expressly described in reference to enclosure 1526, reference is made to the other embodiments disclosed herein.

Figure 31:
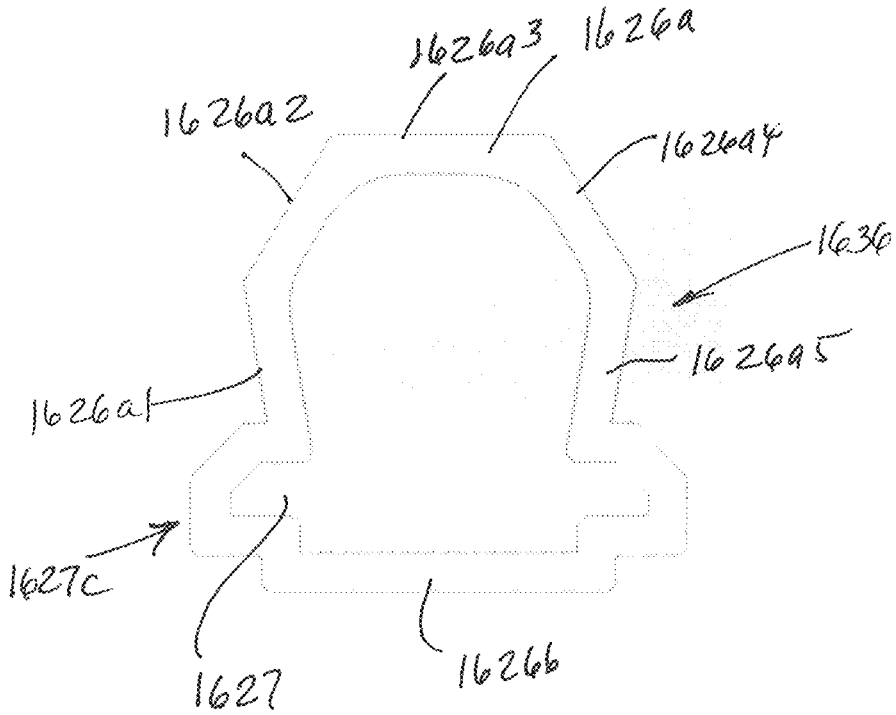
FIG. 31 is an end view of another embodiment of a light assembly (with the light circuit board removed)

Referring to FIG. 31 (only cross-section of elongated enclosure is shown), enclosure 1636 (light sources and light circuit board not shown) is similar to enclosure 1536 except that upper wall 1626*a* is segment similar to enclosure 926, with a plurality of wall segments 1636*a*1, 1636*a*2, 1626*a*3, 1626*a*4, and 1626*a*5. In the illustrated embodiment, each of the wall segments has a planar outer surface but a curved inner surface. In this manner, while the enclosure produces a generally even "glow" of light, there are still noticeable changes in the light pattern across the width of the light emitting surface, though possibly slightly less noticeable than where the segments are planar on both their outer surfaces and their inner surfaces. For further details not expressly described in reference to enclosure 1626, reference is made to the other embodiments disclosed herein.

Figure 32:
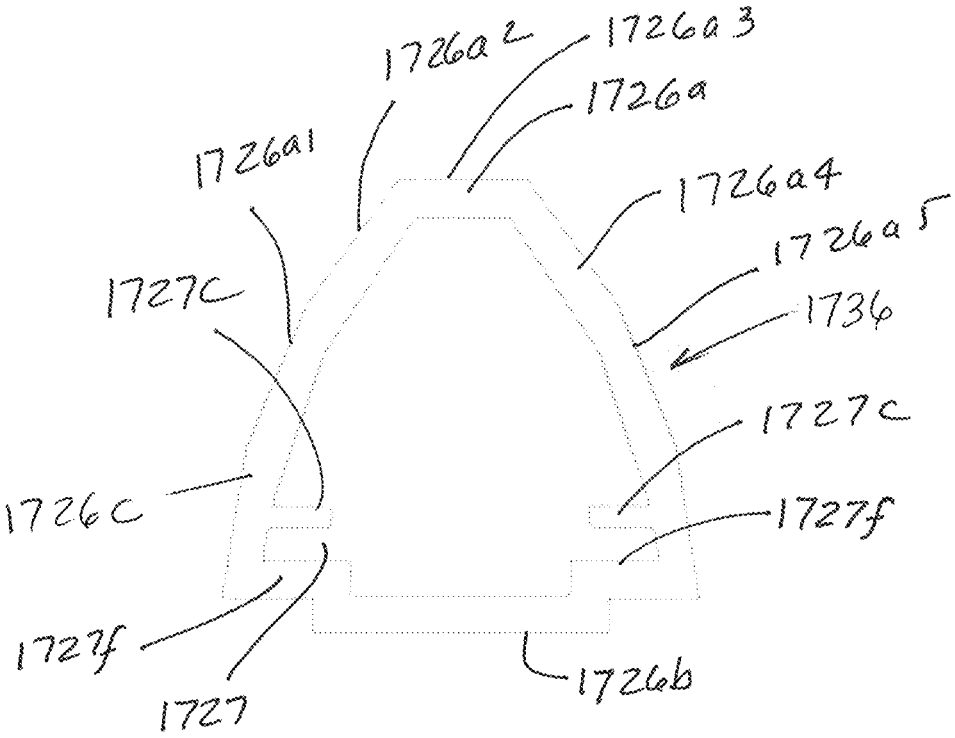
FIG. 32 is an end view of another embodiment of a light assembly (with the light circuit board removed)

Referring to FIG. 32 (only cross-section of elongated enclosure is shown), the numeral 1736 designates yet another embodiment of the enclosure for the light assembly. Unlike the previous embodiments, enclosure 1736 includes a pair of opposed projections 1727*c* that extend from the side walls 1726*c* to form a channel 1727 between projections and base wall 1726*b* and lower horizontal flanges 1727*f*, which connect the side walls 1726*c* to base wall 1726*b*. Additionally, flanges 1727*f* form supports to support light circuit board thereon. Optionally, though not shown in FIG. 32, channel 1727 may also include one or more supports 630 between flanges 1727*f*, which are formed on or by base wall 1726*b* to thereby provide additional support for the light circuit board (not shown in FIG. 31, but shown in reference to the above embodiments).

Similar to enclosure 926, upper wall 1726*a* is segment with a plurality of wall segments 1736*a*1, 1736*a*2, 1726*a*3, 1726*a*4, and 1726*a*5. In the illustrated embodiment, each of the wall segments has a planar outer surface and a planar inner surface. In this manner, while the enclosure produces a generally even "glow" of light, there are still noticeable changes in the light pattern across the width of the light emitting surface, especially at the junctures of the wall segments. For further details not expressly described in reference to enclosure 1726, reference is made to the other embodiments disclosed herein.

Figure 33:
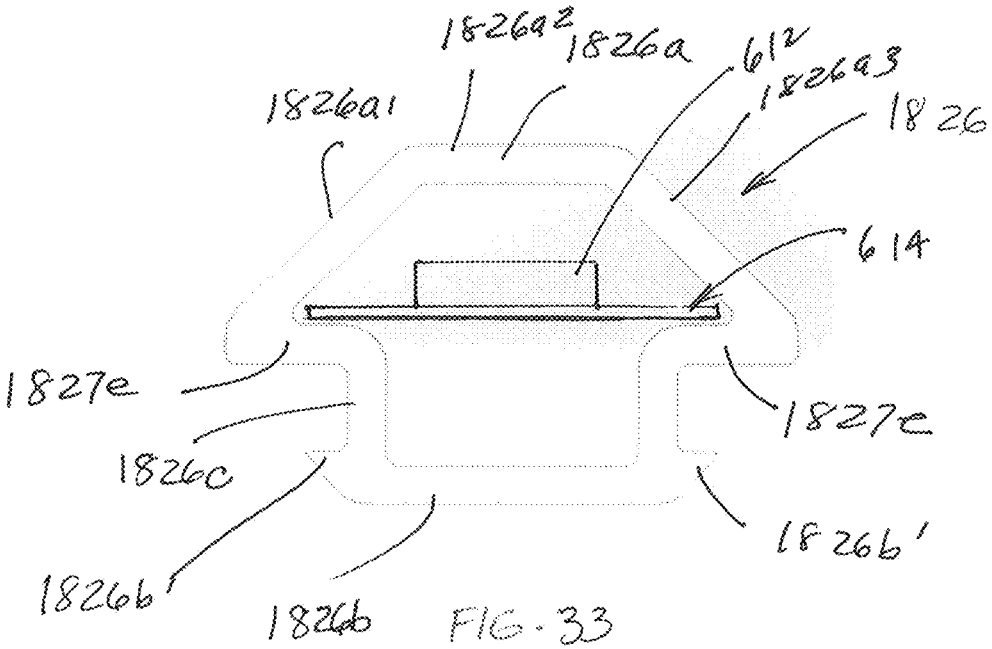
FIG. 33 is an end view of another embodiment of a light assembly.

Referring to FIG. 33 (only cross-section of elongated enclosure is shown), the numeral 1826 designates yet another embodiment of the enclosure for the light assembly. Unlike the previous embodiments, enclosure 1826 supports its light circuit board spaced above the side walls and in the region formed by upper wall 1826*a*. Enclosure 1826 includes generally L-shaped side walls 1826*c*, which connect to the upper wall 1826*a* by outwardly projecting wall portions or flanges 1827*e*, which form supports to support light circuit board 614 thereon. The lower ends of side walls 1826*c* connect to base wall 1826*b*, which optionally includes outwardly projecting flanges 1826*b*', which together with flanges 1827*e* can form engagement structures for one or more mounting members, such as described above.

Similar to several of the above embodiments, upper wall 1826*a* may be segment with planar wall segments 1826*a*1, 1826*a*2, and 1826*a*3. Again, segments 1826*a*1, 1826*a*2, and 1826*a*3 may have uniform thicknesses or may vary. In this manner, with the closer spacing of the light sources to upper wall, the light output tends to be brighter and the individual lights may be seen, which is referred to as "hot spots". For further details not expressly described in reference to enclosure 1826, reference is made to the other embodiments disclosed herein.

In any of the above, the upper walls may be configured to form a primary light output surface and secondary light output surfaces on either side of the primary light output surface depending on several factors, including the internal height of the flexible enclosure, the height of the support (or supports), the shaped of the upper wall, the height of and space between the side walls that straddle the light sources, and/or the cross-section of the upper wall. As noted, the upper wall may be curved or may have planar sections, or may have a variable wall thickness.

As described, in some embodiments, the side walls are offset to form the recesses to ease engagement by mounting members. In another embodiments, the recesses are formed by notches that extend into the side walls.

While several forms of the invention have been show and described in reference to several embodiments, it should be understood that one or more features of one embodiment making be combined with features of another embodiment. Further while directional terms "upper", "lower", "top", and "bottom" have been used, these terms are used generally in reference the orientations shown in the figures. As would be understood by those skilled in the art, the light assemblies may be inverted and mounted the underside of a structure.

We claim:

1. A flexible light assembly comprising:

a flexible light circuit board, the circuit board including a bottom surface and a top surface with a plurality of light sources mounted thereto; and a flexible elongated enclosure enclosing said flexible light circuit board, said flexible elongated enclosure includes an upper wall forming a light emitting surface, opposed side walls, and a base wall, and said base wall forming a channel in said flexible elongated enclosure with a bottom surface formed by an upper side of the bottom surface and at least one support for supporting the flexible light circuit board above said bottom surface of said channel wherein when said flexible light circuit board is inserted into said channel of said flexible elongated enclosure there is a space between said bottom side of said flexible light circuit board and said bottom surface of said channel to allow air flow there between.

2. The flexible light assembly according to claim 1, wherein said flexible elongated enclosure is made from a transparent or translucent material, and said space between said flexible light circuit board and said bottom surface of said channel is sufficiently small to allow said bottom surface of said flexible light circuit to be visible through said base wall of said flexible elongated enclosure.

3. The flexible light assembly according to claim 1, wherein said support has a cross-section selected from the group consisting curved shapes and multi-sided shapes.

4. The flexible light assembly according to claim 1, wherein said support is located in a region of the base wall of the enclosure, and said flexible elongated enclosure has a generally uniform wall thickness except for the region where the support is located.

5. The flexible light assembly according to claim 1, wherein said upper wall has a variable wall thickness to vary the output of the light through the light emitting surface of the enclosure.

6. The flexible light assembly according to claim 1, wherein said flexible elongated enclosure includes recesses formed in or by its opposed side walls to receive the opposed flanges of a clip or a mounting channel-shaped member.

7. The flexible light assembly according to claim 6, further comprising a mounting channel-shaped member with a base wall and two opposed flanges that extend upwardly from the base wall to thereby form channel there between receiving the flexible elongated enclosure.

8. The flexible light assembly according to claim 6, wherein said opposed flanges of the mounting channel-shaped member are spaced apart and extend into said recesses of said flexible elongated enclosure below said light output surface so as not to reduce the light output of said flexible light assembly.

9. A flexible light assembly comprising:

a flexible light circuit board, the circuit board including a plurality of light sources mounted thereto;

a controller electrically coupled to said light sources for selectively powering said light sources;

a pair of electrical leads electrically coupled to said controller for connecting to a power supply to deliver power to said controller;

a wireless receiver for receiving wireless signals from a remote wireless transmitter, the wireless receiver in communication with said controller, and said controller responsive to signals from said wireless receiver and operable to control said light sources based on the signals from said wireless receiver; and a flexible enclosure housing said controller and said wireless receiver and housing a portion of said light circuit board and said leads to form said flexible light assembly.

10. The flexible light assembly according to claim 9, wherein said wireless receiver comprises a WiFi receiver or a Bluetooth receiver.

11. The flexible light assembly according to claim 9, further comprising an adhesive layer with a release tape for mounting said flexible light assembly.

12. The flexible light assembly according to claim 9, further comprising a control circuit board and wherein said controller is mounted to said control circuit board.

13. The flexible light assembly according to claim 9, wherein said flexible enclosure comprises a silicone or polyurethane material.

14. The flexible light assembly according to claim 9, wherein said flexible enclosure comprise a heat shrinkable plastic tube.

15. The flexible light assembly according to claim 12, wherein said flexible enclosure houses said control circuit board and forms a planar bearing side below said control circuit board.

16. The flexible light assembly according to claim 15, wherein said control circuit board includes an edge, said leads extending from said edge of said control circuit board, and said flexible enclosure extending beyond said edge of the control circuit board to enclose a portion of said electrical leads adjacent said control circuit board to form a strain relief for said electrical leads.

17. The flexible light assembly according to claim 9, further comprising a sealing layer enclosing said controller and said wireless receiver and at least partially enclosing said light circuit board, wherein said flexible enclosure houses at least a portion of said sealing layer.

18. The flexible light assembly according to claim 17, wherein said sealing layer forms a light emitting side for said light sources.

19. The flexible light assembly according to claim 18, wherein said light circuit board has a longitudinal axis, and said light emitting side has an arcuate outer surface about said longitudinal axis.

20. The flexible light assembly according to claim 9, wherein said light sources comprise LED lights.

21. A method of forming a flexible light assembly, the method comprising:

providing a light circuit board with a plurality of spaced light sources;

providing a controller in communication with the light sources;

providing a wireless receiver in communication with the controller;

providing a pair of electrical leads for connecting the controller to a power supply;

enclosing the light circuit board in a layer of adhesive; and enclosing at least a portion of the layer of adhesive, the circuit board, and the leads in a flexible material, and optionally the enclosing comprises heat shrinking a tube about at least a portion of the layer of adhesive, the circuit board, and the leads in a flexible material.

* * * * *